US012366400B2

(12) United States Patent
Chasteen et al.

(10) Patent No.: US 12,366,400 B2
(45) Date of Patent: Jul. 22, 2025

(54) SHIPPING SYSTEM FOR STORING AND/OR TRANSPORTING TEMPERATURE-SENSITIVE MATERIALS

(71) Applicant: Cold Chain Technologies, LLC, Franklin, MA (US)

(72) Inventors: James R. Chasteen, Ann Arbor, MI (US); Theodore Smith, Watertown, MA (US)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 293 days.

(21) Appl. No.: 17/687,382

(22) Filed: Mar. 4, 2022

(65) Prior Publication Data

US 2022/0333840 A1 Oct. 20, 2022

Related U.S. Application Data

(60) Provisional application No. 63/156,855, filed on Mar. 4, 2021.

(51) Int. Cl.
*F25D 11/00* (2006.01)
*B65B 5/06* (2006.01)
(Continued)

(52) U.S. Cl.
CPC ..... *F25D 11/003* (2013.01); *B65B 5/06* (2013.01); *B65B 55/00* (2013.01); *B65D 81/107* (2013.01);
(Continued)

(58) Field of Classification Search
CPC ..... F25D 11/003; F25D 11/006; F25D 3/06; B65B 5/06; B65B 55/00; B65B 81/107; B65B 81/3818; B65B 81/3823
See application file for complete search history.

(56) References Cited

U.S. PATENT DOCUMENTS 2,289,060 A 7/1942 Merkle
2,317,005 A 4/1943 Wasserman
(Continued)

FOREIGN PATENT DOCUMENTS

CN 100455956 C 1/2009
CN 101811601 A 8/2010
(Continued)

OTHER PUBLICATIONS

International Search Report mailed Jun. 22, 2022, from PCT Application No. PCT/US22/19015, the corresponding PCT application to the present application.
(Continued)

*Primary Examiner* — Elizabeth J Martin
(74) *Attorney, Agent, or Firm* — KRIEGSMAN & KRIEGSMAN

(57) ABSTRACT

Method and system are designed for storing and/or transporting temperature-sensitive materials. The system is designed to keep a payload within a desired temperature range of +2° C. to +8° C. for an extended time in a warm ambient environment. The system includes a thermally insulated container and first and second phase-change materials, each of the phase-change materials having a different solid/liquid phase-change temperature. Both phase-change materials are preconditioned to a solid state for pack-out. The first phase-change material has a solid/liquid phase-change temperature that is within the desired temperature range and that is at or below a hibernation temperature of about +5° C. to +6° C. The second phase-change material has a solid/liquid phase-change temperature that is above the hibernation temperature. When placed in the warm ambient environment, both phase-change materials move towards melting; however, when subsequently placed in hibernation,
(Continued)

the second phase-change material reverses the direction of its phase change, becoming recharged.

31 Claims, 16 Drawing Sheets

(51) Int. Cl.
*B65B 55/00* (2006.01)
*B65D 81/107* (2006.01)
*B65D 81/38* (2006.01)

(52) U.S. Cl.
CPC ..... *B65D 81/3818* (2013.01); *B65D 81/3823* (2013.01)

(56) References Cited

U.S. PATENT DOCUMENTS 2,467,268 A 4/1949 Merkle
2,515,709 A 7/1950 Heard et al.
2,844,299 A 7/1958 Kessler et al.
3,828,960 A 8/1974 Walles
3,890,762 A 6/1975 Ernst et al.
3,980,005 A 9/1976 Buonaiuto
3,993,811 A 11/1976 Walles
4,206,616 A 6/1980 Frank et al.
4,292,817 A 10/1981 Loucks
4,294,079 A 10/1981 Benson
4,311,022 A 1/1982 Hall
4,377,075 A 3/1983 Russo
4,446,705 A 5/1984 Loucks
4,527,370 A 7/1985 Schuette
4,529,638 A 7/1985 Yamamoto et al.
4,682,708 A 7/1987 Pool
4,819,793 A 4/1989 Williard et al.
4,889,252 A 12/1989 Rockom et al.
4,903,493 A 2/1990 Van Iperen et al.
4,928,847 A 5/1990 Hollander et al.
4,931,333 A 6/1990 Henry
4,947,658 A 8/1990 Wheeler et al.
5,042,260 A 8/1991 George, Sr.
5,102,004 A 4/1992 Hollander et al.
5,111,957 A 5/1992 Hollander et al.
5,216,900 A 6/1993 Jones
5,218,923 A 6/1993 LaRosa
5,323,911 A 6/1994 Johnston et al.
5,450,977 A 9/1995 Moe
5,501,338 A 3/1996 Preston
5,570,588 A 11/1996 Lowe
5,586,438 A 12/1996 Fahy
5,647,226 A 7/1997 Scaringe et al.
5,669,233 A 9/1997 Cook et al.
5,709,307 A 1/1998 Rosado et al.
5,755,987 A 5/1998 Goldstein et al.
5,897,017 A 4/1999 Lantz
5,899,088 A 5/1999 Purdum
5,924,302 A 7/1999 Derifield
5,979,693 A 11/1999 Bane, III
6,041,958 A 3/2000 Tremelo
6,044,650 A 4/2000 Cook et al.
6,055,825 A 5/2000 Choy
6,070,427 A 6/2000 Fine et al.
6,106,449 A 8/2000 Wynne
6,116,042 A 9/2000 Purdum
6,131,376 A 10/2000 Grey et al.
6,168,040 B1 1/2001 Sautner et al.
6,189,330 B1 2/2001 Retallick et al.
6,192,703 B1 2/2001 Salyer et al.
6,209,343 B1 4/2001 Owen
6,233,965 B1 5/2001 Choy
6,244,458 B1 6/2001 Frysinger et al.
6,257,764 B1 7/2001 Lantz
6,295,830 B1 10/2001 Newman
6,325,281 B1 12/2001 Grogan
6,336,340 B1 1/2002 Laby
6,427,475 B1 8/2002 DeFelice et al.
6,450,398 B1 9/2002 Muise et al.
6,482,332 B1 11/2002 Malach
6,490,880 B1 12/2002 Walsh
6,519,968 B1 2/2003 Konarski
6,557,370 B2 5/2003 Gano, III
6,564,992 B1 5/2003 Wegner
6,584,797 B1 7/2003 Smith et al.
6,619,500 B1 9/2003 Lantz
6,645,598 B2 11/2003 Alderman
6,668,577 B2 12/2003 Quenedey
6,718,776 B2 4/2004 Wessling et al.
6,771,183 B2 8/2004 Hunter
6,838,146 B2 1/2005 Merrill et al.
6,868,982 B2 3/2005 Gordon
6,875,486 B2 4/2005 Miller
6,910,582 B2 6/2005 Lantz
7,028,504 B2 4/2006 Derifield
7,057,527 B2 6/2006 Hunter
7,131,289 B2 11/2006 Harl et al.
7,147,626 B2 12/2006 Goodman et al.
7,225,632 B2 6/2007 Derifield
7,240,513 B1 7/2007 Conforti
7,257,963 B2 8/2007 Mayer
7,294,374 B2 11/2007 Romero
7,318,535 B2 1/2008 Gano, III et al.
7,328,583 B2 2/2008 Hillman et al.
7,422,143 B2 9/2008 Mayer
7,500,593 B2 3/2009 Mayer
7,537,817 B2 5/2009 Tsunetsugu et al.
7,624,873 B2 12/2009 Tennant et al.
7,624,911 B2 12/2009 Spurrell et al.
7,641,812 B2 1/2010 Alderman
7,677,406 B2 3/2010 Maxson
7,681,405 B2 3/2010 Williams
7,704,584 B2 4/2010 Alderman
7,721,566 B1 5/2010 Wilken
7,849,708 B2 12/2010 Goncharko et al.
7,862,876 B2 1/2011 Yuasa et al.
7,896,182 B1 3/2011 Hansen et al.
7,908,870 B2 3/2011 Williams et al.
7,909,806 B2 3/2011 Goodman et al.
7,919,163 B2 4/2011 Romero
7,950,246 B1 5/2011 Mayer et al.
8,056,357 B2 11/2011 Bruce
8,074,465 B2 12/2011 Heroux et al.
8,156,703 B2 4/2012 Alderman
8,199,019 B2 6/2012 Kaczmarz et al.
8,202,599 B2 6/2012 Henn
8,250,882 B2 8/2012 Mustafa et al.
8,313,818 B2 11/2012 Vo et al.
8,333,279 B2 12/2012 Veiseh
8,342,588 B2 1/2013 Skaradzinski
8,349,552 B2 1/2013 Haarmann et al.
8,375,730 B2 2/2013 Haarmann et al.
8,424,317 B2 4/2013 Dain et al.
8,424,335 B2 4/2013 Corder et al.
8,607,581 B2 12/2013 Williams et al.
8,613,202 B2 12/2013 Williams
8,763,423 B2 7/2014 Tattam
8,763,811 B2 7/2014 Lantz
8,881,398 B2 11/2014 Han
8,881,540 B1 11/2014 Barakat et al.
8,887,515 B2 11/2014 Patstone
8,899,071 B2 12/2014 Mogil et al.
8,904,810 B2 12/2014 Schabron et al.
8,919,082 B1 12/2014 Cataldo
8,935,934 B2 1/2015 Barakat
8,938,986 B2 1/2015 Matta et al.
8,956,710 B2 2/2015 Jang et al.
9,022,249 B2 5/2015 Ranade
9,045,278 B2 6/2015 Mustafa et al.
9,060,508 B2 6/2015 Anti et al.
9,151,531 B2 10/2015 Wengreen et al.
9,180,998 B2 11/2015 Banks et al.
9,272,475 B2 3/2016 Ranade et al.
9,366,469 B2 6/2016 Chapman, Jr.
9,373,099 B2 6/2016 Barakat
9,376,605 B2 6/2016 Matta et al.

(56) References Cited

U.S. PATENT DOCUMENTS 9,400,966 B2 7/2016 Dertadian
9,429,350 B2 8/2016 Chapman, Jr.
9,513,067 B2 12/2016 Ahmed
9,550,618 B1 1/2017 Jobe
9,556,373 B2 1/2017 Formato et al.
9,598,622 B2 3/2017 Formato et al.
9,611,067 B2 4/2017 Collison
9,688,454 B2 6/2017 Ranade et al.
9,707,156 B2 7/2017 Wengreen et al.
9,719,688 B2 8/2017 Holloway et al.
9,751,682 B2 9/2017 Mayer et al.
9,814,651 B2 11/2017 Wengreen et al.
9,828,137 B2 11/2017 Albert et al.
9,828,165 B2 11/2017 Ranade
9,834,365 B2 12/2017 Pointer et al.
9,877,894 B2 1/2018 Wengreen et al.
9,913,777 B2 3/2018 Wengreen et al.
9,926,102 B2 3/2018 Baker
9,944,449 B2 4/2018 Wood et al.
9,950,851 B2 4/2018 Ranade
9,956,140 B2 5/2018 Wengreen et al.
9,957,098 B2 5/2018 Jobe
9,957,099 B2 5/2018 White et al.
9,963,287 B2 5/2018 Vogel et al.
9,975,686 B2 5/2018 Caps
9,981,797 B2 5/2018 Aksan et al.
10,077,389 B2 9/2018 Formato et al.
10,104,876 B2 10/2018 Garland et al.
10,168,090 B1 1/2019 Chapman, Jr.
10,274,247 B2 4/2019 Jeong et al.
10,329,074 B2 6/2019 Ranade et al.
10,501,254 B2 12/2019 Wood et al.
10,508,854 B2 12/2019 Demuth et al.
10,583,978 B2 3/2020 Longley et al.
10,604,326 B2 3/2020 Longley et al.
10,610,985 B2 4/2020 Liu et al.
10,647,498 B1 5/2020 Brygier, III
10,661,969 B2 5/2020 Pranadi et al.
10,669,466 B2 6/2020 Miyashita
10,766,685 B2 9/2020 Kuhn et al.
10,829,675 B2 11/2020 Formato et al.
10,928,115 B2 2/2021 Anstead et al.
10,946,562 B2 3/2021 Mohmeyer et al.
10,962,270 B2 3/2021 Jain et al.
10,968,625 B2 4/2021 Mack et al.
11,040,818 B2 6/2021 Jobe
11,078,008 B2 8/2021 Dankbaar et al.
11,130,622 B2 9/2021 Goellner
11,137,190 B2 10/2021 Martino
11,287,079 B2 3/2022 Biswas et al.
11,446,915 B2 9/2022 Biswas et al.
11,499,770 B2 11/2022 Rizzo et al.
11,511,928 B2 11/2022 Rizzo et al.
11,518,602 B2 12/2022 Knight
11,535,443 B2 12/2022 Caps
11,591,133 B2 2/2023 Longley et al.
11,634,264 B2 4/2023 Caps
11,649,639 B2 5/2023 Olvey et al.
11,731,826 B2 8/2023 Blezard et al.
11,857,496 B2 1/2024 Blezard et al.
11,953,262 B2 4/2024 Blezard et al.
12,043,470 B2 7/2024 Rizzo et al.
12,056,654 B1 8/2024 Chasteen et al.
2002/0134962 A1 9/2002 Romero
2002/0144482 A1 10/2002 Henson et al.
2003/0102317 A1 6/2003 Gordon
2004/0020236 A1* 2/2004 Vince, II ..... F25D 16/00 62/332
2004/0131871 A1 7/2004 Lee et al.
2004/0151851 A1 8/2004 Miller
2005/0098255 A1 5/2005 Lembo et al.
2005/0189404 A1 9/2005 Xiaohai et al.
2005/0224501 A1 10/2005 Folkert et al.
2006/0175227 A1 8/2006 Lau
2006/0240216 A1 10/2006 Stepanian et al.
2007/0028642 A1 2/2007 Glade et al.
2007/0051734 A1 3/2007 Kuhn
2007/0186577 A1 8/2007 Goncharko
2007/0193297 A1 8/2007 Wilson
2007/0193298 A1 8/2007 Derifield
2008/0006628 A1 1/2008 Goncharko et al.
2008/0135564 A1 6/2008 Romero
2008/0164265 A1 7/2008 Conforti
2009/0078708 A1 3/2009 Williams
2009/0230138 A1 9/2009 Williams et al.
2010/0012653 A1 1/2010 Ulrich et al.
2010/0038369 A1 2/2010 CaNas et al.
2010/0062519 A1 3/2010 Franklin, Jr. et al.
2010/0072211 A1 3/2010 Dickinson et al.
2010/0289669 A1 11/2010 Saltzman et al.
2010/0299278 A1 11/2010 Kriss et al.
2010/0314397 A1 12/2010 Williams et al.
2010/0326993 A1 12/2010 Mayer et al.
2011/0079330 A1 4/2011 Raine
2011/0248038 A1 10/2011 Mayer
2011/0253289 A1 10/2011 Shepard
2011/0290792 A1* 12/2011 Krzak ..... F25D 3/08 220/1.5
2012/0009376 A1 1/2012 Rusek, Jr.
2012/0237716 A1 9/2012 Fukuzawa et al.
2012/0248101 A1 10/2012 Tumber et al.
2013/0020309 A1 1/2013 Tattam et al.
2013/0055750 A1 3/2013 Mustafa et al.
2013/0062355 A1 3/2013 Shulman
2013/0213977 A1 8/2013 Stathes et al.
2013/0228583 A1 9/2013 Mayer
2013/0245991 A1 9/2013 Kriss
2013/0255306 A1 10/2013 Mayer
2014/0008042 A1 1/2014 Schryver et al.
2014/0054297 A1 2/2014 Patstone
2014/0091098 A1 4/2014 Casoli
2014/0138392 A1 5/2014 McCormick
2014/0144161 A1 5/2014 Pointer et al.
2014/0157797 A1 6/2014 Kovalick et al.
2014/0311170 A1 10/2014 Mills et al.
2014/0319018 A1 10/2014 Collison
2014/0331711 A1 11/2014 Blezard et al.
2014/0343493 A1 11/2014 Wengreen
2015/0068242 A1 3/2015 Patstone
2015/0090728 A1 4/2015 Lubart et al.
2015/0150244 A9 6/2015 Annis et al.
2015/0166244 A1 6/2015 Wood et al.
2015/0191291 A1 7/2015 Wood et al.
2015/0217927 A1 8/2015 Ranade
2015/0239639 A1 8/2015 Wenner et al.
2015/0259126 A1 9/2015 McGoff et al.
2015/0274415 A1 10/2015 Farrar et al.
2015/0276297 A1 10/2015 Moore et al.
2016/0039594 A1 2/2016 Ranade
2016/0075498 A1 3/2016 Mayer et al.
2016/0123648 A1 5/2016 Leaverton
2016/0130066 A1 5/2016 Ranade et al.
2016/0161171 A1 6/2016 Blezard et al.
2016/0262979 A1 9/2016 Wengreen et al.
2016/0305598 A1 10/2016 Ranade
2016/0311600 A1 10/2016 Albert et al.
2016/0341711 A1 11/2016 Rice et al.
2016/0362240 A1 12/2016 Ferracamo, Jr.
2017/0001406 A1 1/2017 Graf et al.
2017/0001422 A1 1/2017 Bauernfeind
2017/0010037 A1 1/2017 Allard et al.
2017/0015488 A1 1/2017 Caps
2017/0072604 A1 3/2017 Sjong
2017/0073146 A1 3/2017 Kuhn et al.
2017/0073147 A1 3/2017 Kuhn
2017/0082344 A1 3/2017 Tansley
2017/0113868 A1 4/2017 Ahmed et al.
2017/0121097 A1 5/2017 Pranadi et al.
2017/0131015 A1 5/2017 Farrar
2017/0146276 A1 5/2017 Newman
2017/0158411 A1 6/2017 Taka et al.
2017/0198959 A1 7/2017 Morris
2017/0225869 A1 8/2017 Ranade
2017/0240337 A1 8/2017 Austerberry et al.

(56) References Cited

U.S. PATENT DOCUMENTS

| | | | |
|---|---|---|---|
| 2017/0284723 | A1 | 10/2017 | Newman |
| 2017/0305639 | A1 | 10/2017 | Kuhn et al. |
| 2018/0036202 | A1 | 2/2018 | Wengreen et al. |
| 2018/0086534 | A1 | 3/2018 | Kilmer et al. |
| 2018/0093816 | A1 | 4/2018 | Longley et al. |
| 2018/0100682 | A1 | 4/2018 | Nilsen et al. |
| 2018/0148245 | A1 | 5/2018 | Aggarwal et al. |
| 2018/0202700 | A1 | 7/2018 | Anstead et al. |
| 2018/0237207 | A1 | 8/2018 | Aksan et al. |
| 2018/0282049 | A1 | 10/2018 | Tumber et al. |
| 2018/0320947 | A1 | 11/2018 | Jain et al. |
| 2018/0328644 | A1 | 11/2018 | Rizzo et al. |
| 2019/0210790 | A1* | 7/2019 | Rizzo ..... B65D 81/18 |
| 2019/0219320 | A1 | 7/2019 | Wood et al. |
| 2019/0241350 | A1 | 8/2019 | Goellner |
| 2019/0248573 | A1 | 8/2019 | Collison et al. |
| 2019/0316345 | A1 | 10/2019 | Caps et al. |
| 2019/0359407 | A1 | 11/2019 | Kale et al. |
| 2020/0002075 | A1 | 1/2020 | Lee et al. |
| 2020/0047993 | A1 | 2/2020 | Brabbs et al. |
| 2020/0087052 | A1 | 3/2020 | Lyons |
| 2020/0122909 | A1 | 4/2020 | Jobe |
| 2020/0141531 | A1 | 5/2020 | Rell et al. |
| 2020/0156852 | A1 | 5/2020 | Veiseh |
| 2020/0231362 | A1 | 7/2020 | Kulangara et al. |
| 2020/0307896 | A1 | 10/2020 | Pranadi et al. |
| 2020/0324959 | A1 | 10/2020 | Longley et al. |
| 2020/0331686 | A1 | 10/2020 | Longley et al. |
| 2020/0378544 | A1 | 12/2020 | Bock et al. |
| 2020/0408453 | A1 | 12/2020 | Martino |
| 2021/0024270 | A1 | 1/2021 | Mirzaee Kakhki |
| 2021/0070539 | A1 | 3/2021 | Chasteen et al. |
| 2021/0102746 | A1 | 4/2021 | Waltemire et al. |
| 2021/0247122 | A1 | 8/2021 | Sezukuri et al. |
| 2021/0253330 | A1 | 8/2021 | Madanagopal et al. |
| 2021/0278120 | A1 | 9/2021 | Kuhn et al. |
| 2021/0300665 | A1 | 9/2021 | Melchor |
| 2021/0301970 | A1 | 9/2021 | Yamashita et al. |
| 2021/0309442 | A1 | 10/2021 | Kletzel et al. |
| 2022/0002070 | A1 | 1/2022 | Moghaddas et al. |
| 2022/0194678 | A1 | 6/2022 | Kilmer |
| 2022/0194682 | A1 | 6/2022 | Michel et al. |
| 2022/0267081 | A1 | 8/2022 | Conway et al. |
| 2022/0267657 | A1 | 8/2022 | Blezard et al. |
| 2022/0333840 | A1 | 10/2022 | Chasteen et al. |
| 2022/0343270 | A1 | 10/2022 | Melchor et al. |
| 2022/0388756 | A1 | 12/2022 | Birgersen et al. |
| 2023/0064825 | A1 | 3/2023 | Conway et al. |
| 2023/0131560 | A1 | 4/2023 | Blezard et al. |
| 2023/0173785 | A1 | 6/2023 | Kuhn et al. |
| 2023/0202141 | A1 | 6/2023 | Bock et al. |
| 2023/0227236 | A1 | 7/2023 | Nilsen et al. |
| 2023/0249896 | A1 | 8/2023 | Blezard |
| 2023/0257185 | A1 | 8/2023 | Goellner et al. |
| 2023/0312219 | A1 | 10/2023 | Robertson et al. |
| 2023/0351311 | A1 | 11/2023 | Shanmugavelayudam et al. |
| 2024/0142153 | A1 | 5/2024 | Emond et al. |

FOREIGN PATENT DOCUMENTS

| | | | |
|---|---|---|---|
| CN | 201980585 | U | 5/2012 |
| CN | 202244410 | U | 2/2013 |
| CN | 202831270 | U | 3/2013 |
| CN | 202945694 | U | 5/2013 |
| CN | 202728724 | U | 5/2014 |
| CN | 203601782 | U | 5/2014 |
| CN | 103964076 | A | 8/2014 |
| CN | 106081351 | A | 11/2016 |
| CN | 103672303 | B | 1/2017 |
| CN | 207644932 | U | 7/2018 |
| CN | 105971183 | B | 12/2018 |
| CN | 108943947 | B | 12/2018 |
| CN | 209410800 | U | 9/2019 |
| CN | 110513569 | A | 11/2019 |
| CN | 110549701 | A | 12/2019 |
| CN | 109185603 | B | 8/2020 |
| CN | 211944580 | U | 11/2020 |
| CN | 211951909 | U | 11/2020 |
| CN | 114834112 | A | 8/2022 |
| CN | 115012544 | A | 9/2022 |
| CN | 116061527 | A | 5/2023 |
| CN | 116065714 | A | 5/2023 |
| CN | 114321570 | B | 8/2023 |
| CN | 107804573 | B | 11/2023 |
| DE | 1486302 | B1 | 9/1970 |
| DE | 10107478 | A1 | 9/2002 |
| DE | 10123453 | A1 | 11/2002 |
| DE | 10131136 | A1 | 1/2003 |
| DE | 10336835 | A1 | 3/2005 |
| DE | 202007012289 | U1 | 11/2007 |
| DE | 102007059799 | A1 | 6/2008 |
| DE | 102008036669 | A1 | 2/2010 |
| DE | 102014003413 | A1 | 9/2015 |
| DE | 202015004047 | U1 | 10/2016 |
| DE | 202017003908 | U1 | 9/2017 |
| DE | 102017119920 | A1 | 12/2018 |
| DE | 202019001700 | U1 | 9/2019 |
| DE | 202022101226 | U1 | 4/2022 |
| EP | 1006058 | A1 | 6/2000 |
| EP | 1177984 | A2 | 2/2002 |
| EP | 1336574 | A2 | 8/2003 |
| EP | 1887154 | A2 | 2/2008 |
| EP | 2050884 | A2 | 4/2009 |
| EP | 1500752 | B1 | 10/2010 |
| EP | 1898014 | B1 | 1/2013 |
| EP | 2700891 | A2 | 2/2014 |
| EP | 2081838 | B1 | 8/2014 |
| EP | 2883811 | A1 | 6/2015 |
| EP | 3421860 | B1 | 6/2020 |
| EP | 3808684 | A1 | 4/2021 |
| EP | 4230596 | A1 | 8/2023 |
| FR | 2604981 | B1 | 6/1989 |
| FR | 2697809 | A1 | 5/1994 |
| FR | 2884810 | A1 | 10/2006 |
| FR | 2948342 | B1 | 9/2011 |
| FR | 2994420 | A1 | 2/2014 |
| GB | 2492195 | B | 6/2013 |
| GB | 2548887 | B | 3/2019 |
| GB | 2566792 | A | 3/2019 |
| JP | 06298283 | A | 10/1994 |
| JP | 2000211667 | A | 8/2000 |
| JP | 2006306422 | A | 11/2006 |
| JP | 2007191195 | A | 8/2007 |
| JP | 2007253974 | A | 10/2007 |
| JP | 2008068871 | A | 3/2008 |
| JP | 2009113822 | A | 5/2009 |
| JP | 2010089802 | A | 4/2010 |
| JP | 2010208644 | A | 9/2010 |
| JP | 2013010524 | A | 1/2013 |
| JP | 5435435 | B2 | 3/2014 |
| KR | 20030060191 | A1 | 7/2003 |
| KR | 101457029 | B1 | 11/2014 |
| WO | 9747174 | A1 | 12/1997 |
| WO | 1997045326 | A1 | 12/1997 |
| WO | 9916330 | A1 | 4/1999 |
| WO | 9932374 | A1 | 7/1999 |
| WO | 0060184 | A1 | 10/2000 |
| WO | 0144731 | A1 | 6/2001 |
| WO | 2006082433 | A1 | 8/2006 |
| WO | 2007030110 | A1 | 3/2007 |
| WO | 2008133374 | A1 | 11/2008 |
| WO | 2011152610 | A1 | 12/2011 |
| WO | 2012017910 | A1 | 2/2012 |
| WO | 2013014409 | A1 | 1/2013 |
| WO | 2013144621 | A2 | 10/2013 |
| WO | 2014007444 | A1 | 1/2014 |
| WO | 2014067927 | A1 | 5/2014 |
| WO | 2014118821 | A1 | 8/2014 |
| WO | 2014147425 | A2 | 9/2014 |
| WO | 2014163274 | A1 | 10/2014 |
| WO | 2014183019 | A2 | 11/2014 |
| WO | 2015117568 | A1 | 8/2015 |
| WO | 2016033077 | A1 | 3/2016 |
| WO | 2016120224 | A1 | 8/2016 |

(56) References Cited

FOREIGN PATENT DOCUMENTS

| | | | |
|---|---|---|---|
| WO | 2016149627 | A1 | 9/2016 |
| WO | 2016168523 | A1 | 10/2016 |
| WO | 2016208193 | A1 | 12/2016 |
| WO | 2017048793 | A1 | 3/2017 |
| WO | 2017062692 | A1 | 4/2017 |
| WO | 2017072638 | A1 | 5/2017 |
| WO | 2017220953 | A1 | 12/2017 |
| WO | 2017220954 | A1 | 12/2017 |
| WO | 2018075470 | A1 | 4/2018 |
| WO | 2018197049 | A1 | 11/2018 |
| WO | 2018208986 | A1 | 11/2018 |
| WO | 2018213348 | A2 | 11/2018 |
| WO | 2019011478 | A1 | 1/2019 |
| WO | 2020097477 | A1 | 5/2020 |
| WO | 2020235481 | A1 | 11/2020 |
| WO | 2021165698 | A1 | 8/2021 |

OTHER PUBLICATIONS

Written Opinion mailed Jun. 22, 2022, from PCT Application No. PCT/US22/19015, the corresponding PCT application to the present application.
Pack-out Sheet for KoolTemp HP-75 Shipping System, Cold Chain Technologies, Franklin, MA (2011).
Pack-out Sheet for JOM Small Shipper, Cold Chain Technologies, Franklin, MA (2017).
Pack-out Sheet for Sanofi GTS-3L CRT Shipping System, Cold Chain Technologies, Franklin, MA (2017).
Sales literature for AEON reusable shippers, Softbox Systems Limited, Buckinghamshire, UK (2021).
Sales literature for CHILLTECH shipping system, Sonoco Thermosafe, Arlington Heights, IL (2017).
Laminar Medica Company Presentation, Laminar Medica Limited, Hertfordshire, UK (2016).
ThermoSafe catalog, Sonoco ThermoSafe, Arlington Heights, IL (2014).
Sales literature for va-Q-proof shipping solution, va-Q-tec AG, Wuerzburg, Germany (2020).
Sales literature for Chronos Advance shipper, Pelican BioThermal, Maple Grove, MN (2018).
Sales literature for Credo Cube shipper, Pelican BioThermal, Maple Grove, MN (2018).
Almac White Paper, "Changing the Dynamics of Temperature Controlled Shipping Solutions," Almac Group, Craigavon, UK (2017).
Ashokan, "A Comparative Study for Cold Chain Packaging Options," Thesis for Master of Science, Rochester Institute of Technology (2011).
Caps et al., "Quality control of vacuum insulation panels: Methods of measuring gas pressure," Vacuum, 82: 691-699 (2008).
2018 photos taken by Applicant of CHILLTECH shipping system with Zero Bench-Time insert (white).
Saf-T-Pak catalog, Saf-T-Pak Inmark, Edmonton, Canada (2017).
Sonoco Thermosafe catalog, Sonoco ThermoSafe, Arlington Heights, IL (2017).
Sales literature for Vype shipping system, Emball'iso Group, Saint Georges de Reneins, France (2018).
Sales literature for Nomadic Pre-Qualified Shipper, SCA Packaging NA, Arlington Heights, IL (2005).
"Collapsible Insulated Shipping Coolers: Reliable & Cost-Efficient"; https://chill-pak.com/collapsible-insulated-shipping-coolers/; accessed Jun. 3, 2023.
"IPC Full Product Selection"; https://ipcpack.com/products/; accessed Jun. 3, 2023.
"TemPak Fabricated Insulated Shipping Containers"; https://www.cryopak.com/cold-chain-packaging/insulated-containers/tempak-fabricated-insulated-shipping-containers/; accessed Jun. 3, 2023.
"Insulated Shippers: TheraPak Compact Insulated Shippers"; https://www.therapak.com/catalog/insulated-shippers/; accessed Jun. 3, 2023.
"Sealed Air: Tempguard"; https://www.sealedair.com/products/protective-packaging/insulated-box-liners#tempguard-tab; accessed Jun. 3, 2023.
"Sonoco Thermosafe Vacuum Insulated Panel (VIP) Shippers"; https://www.thermosafe.com/products/insulated-shippers/life-sciences-healthcare/vip-shippers/; accessed Jun. 3, 2023.
"Nanopore: Insulated Shipping Containers"; http://www.nanopore.com/shipping.html; accessed Jun. 3, 2023.
"DuraTherm Cold Chain Packaging"; https://www.atlasmoldedproducts.com/packaging/cold-chain; accessed Jun. 3, 2023.
Sales literature for NOMADIC Pre-qualified Shipping System, ISC, Inc., Phoeniz, AZ (2001).
Thermosafe Catalog, SCA Packaging North America, Arlington Heights, Illinois (2004).
"The Quantum PLUS+ Systems," https://radmat.com/protherm-quantum/the-quantum-systems/; accessed Feb. 21, 2024.
"Self-Healing Films for Vacuum Insulation Panels" (Mar. 23, 2021), https://www.energy.gov/eere/buildings/articles/self-healing-films-vacuum-insulation-panels; accessed Feb. 21, 2024.
"Demonstration of self-healing barrier films for vacuum insulation panels," Vacuum, 164:132-139 (Jun. 2019), https://www.sciencedirect.com/science/article/abs/pii/S0042207X1832147X?via%3Dihub; accessed Feb. 21, 2024.
"Self-Healing Films to Improve Durability of VIPs by In-Situ Remediation of Film Defects" (May 22, 2019), https://www.energy.gov/eere/buildings/articles/self-healing-films-improve-durability-vips-situ-remediation-film-defects; accessed Feb. 21, 2024.
"Kaushik Biswas: Making self-healing building materials a reality" (Jun. 6, 2018), https://www.ornl.gov/news/kaushik-biswas-making-self-healing-building-materials-reality; accessed Feb. 21, 2024.
Peng et al., "Structure, Mechanism, and Application of Vacuum Insulation Panels in Chinese Buildings," Advances in Building Technologies and Construction Materials 2016 (May 19, 2016), https://www.hindawi.com/journals/amse/2016/1358072/; accessed Feb. 21, 2024.
"Raising inverted roof performance with encapsulated vacuum insulation panels," pbctoday (Aug. 14, 2023), https://www.pbctoday.co.uk/news/energy-news/raising-inverted-roof-performance-with-vips/131169/; accessed Feb. 21, 2024.
"Vacuum Insulation Panels (VIP) Shippers," https://www.thermosafe.com/products/insulated-shippers/life-sciences-healthcare/vip-shippers/; accessed Feb. 21, 2024.
Frattaruolo, "Reducing temperature excursions in cold chain shipping—The business imperative for using phase-change materials (PCM)," (May 18, 2021), https://csafeglobal.com/blog/2021/05/18/reduce-temperature-excursions- using-vip-and-phase-change-material/; accessed Feb. 21, 2024.
"Reusable Passive Thermal Parcel Shippers," Pelican Biothermal®, pelicanbiothermal.com, Nov. 6, 2016. https://web.archive.org/web/20161106221805/http://pelicanbiothermal.com/therma •• packaging/reusable•parce.
"IBOX," So Fri Gam, sofrigam.com, 201••0••04. https://web.archive.org/web/20170304003303/http://www.sofrigam.com/iBox•col••chain•packaging.
"VIP Series," Panasonic, panasonic.healthcare.com, MD••U76VC•PA | MD••U76VA•PA, Dec. 2, 2016. http://www.panasonic•healthcare.com/us/~/media/biomedical/americas/us/catalogs/Cut%20Sheets/PHCNA_MDF76_product_sheet.pdf.
"V••••Tcon3," VA•••Tec, va•q•tec.com, accessed: May 2017. http://www.v••q•tec.com/en/products•industries/healthcar••logistics/cold•chai••packaging/clinical•trials/v••••tcon.html.
"Vacuum Insulated Panel (VIP) Shippers," Sonoco Thermosafe®, thermosafe.com, Oct. 6, 2015. https://web.archive.org/web/20161006061833/http://www.thermosafe.com:80/insulatedship-pers.
"Simport Cryostore™ Storage Boxes," Thomas Scientific, thomassci.com, 2018. https://www.thomassci.com/Laboratory-Supplies/Boxes/_/CRYOSTORE-Storage-Boxes?q=Cryovial%20Storage%20Boxes.
"Packaging Requirements for Dry Ice," Standard Operating Procedure,ehs.umich.edu, Rev.#2, Univ. of Michigan, Jun. 2, 2017. https://ehs.umich.edu/wp-content/uploads/2018/04/Pkg- Req-Dry-Ice.pdf.

(56) References Cited

OTHER PUBLICATIONS

"Global Thermal Container with Phase Change Materials," World Courier, https://www.youtube.com/watch?v=Mwabx3W-ado (2017).
https://chill-pak.com/collapsible-insulated-shipping-coolers/ (2020).
https://ipcpack.com/products/green-liner/ (2020).
https://www.cryopak.com/packaging-and-refrigerants/insulated-shipping-containers/vip/ (2016).
https://therapak.com/catalog/insulated-shippers/ (2020).
https://www.sealedair.com/products/protective-packaging/insulated-box-liners (2020).
https://www.thermosafe.com/insulatedshippers (2020).
https://www.achfoam.com/Packaging/DuraTherm-Shipping-Containers/DuraTherm-Shipper-Services.aspx (2020).
http://www.nanopore.com/shipping.html (2008).
Pack-out Sheet for HP-76-ST Shipping System, Cold Chain Technologies, Franklin, MA (2011).
Pack-out Sheet for Excel GTS-6L-RFG Shipping Systems, Cold Chain Technologies, Franklin, MA (2014).
Pack-out Sheet for KoolTemp GTS Extreme 7L Shipping System, Cold Chain Technologies, Franklin, MA (2014).
Pack-out Sheet for KoolTemp GTS Excel 26L Shipping System, Cold Chain Technologies, Franklin, MA (2013).
Pack-out Sheet for KoolTemp GTS Extreme 45L Shipping System, Cold Chain Technologies, Franklin, MA (2014).
"Below-zero Complete without Orange bio-bottle," BB: bio-bottle, biobottle.com, Sku: BZOW1, 2018. https://www.bio-bottle.com/shop /below-zero/below-zero-complete-withoutorange-bio-bottle/.
"Cold Chain Logistics Accessories: Cryoport Exclusive Accessories Safepak®," Cryoport, cryoportj.com, 2018. https://www.cryoport.com/servi ces/cold-chain-logistics-accessories.
Romeo, Ben, "Upgrading of Traditional Cold Chain Shipping Systems Using 2-8degree C Phase Change Materials," Pharmaceutical OutsourcingTM, pharmoutsourcing.com, Nov. 27, 2017. http://web.archive.org/web/20171127155311/http://www.pharmoutsourcing.com/Featured-Articles/37644-Upgrading-of-Traditional-Cold-Chain-Shipping-Systems-Using-2-8-C-Phase-Change-Materials/.
"SavENRG Temperature Controlled Container," SavENRG, rgees.com, Dec. 5, 2012. https://web.archive.org/web/20121205011328/http://rgees.com:80/solutions_refrigerated-shipping.php.
"Complete Cold-Chain Design, Implementation and Shipping Services," AeroSafe Global, aerosafeglobal.com, Oct. 16, 2018. https://web.archive.org/web/20181016010215/https://www.aerosafeglobal.com/complete-solution.
"Food Delivery & Supply Chains," Croda, crodatherm.com, Oct. 16, 2018. https://web.archive.org/web/20181016013357/https://www.crodatherm.com/en-gb/products-and-applications/food-and-refrigeration/food-delivery-and-supply-chains.
Singh, Suman, Kirtiraj. K. Gaikwad, and Youn Suk Lee, "Phase change materials for advanced cooling packaging," Environmental Chemistry Letters (2018): 1-15. https://www.researchgate.net/publication/324695298_Phase_change_materials_for_advanced_cooling_packaging.

* cited by examiner

SHIPPING SYSTEM FOR STORING AND/OR TRANSPORTING TEMPERATURE-SENSITIVE MATERIALS

CROSS-REFERENCE TO RELATED APPLICATIONS

The present application claims the benefit under 35 U.S.C. 119(e) of U.S. Provisional Patent Application No. 63/156,855, inventor James R. Chasteen, filed Mar. 4, 2021, the disclosure of which is incorporated herein by reference in its entirety.

BACKGROUND OF THE INVENTION

The present invention relates generally to shipping systems for storing and/or transporting temperature-sensitive materials and relates more particularly to a novel such shipping system.

It is often desirable to store and/or to transport temperature-sensitive materials, examples of such materials including, but not being limited to, pharmaceuticals, medical devices, biological samples, foods, and beverages. As a result, various types of shipping systems for storing and/or transporting such materials have been devised, some of these shipping systems being parcel-sized shipping systems and some of these shipping systems being pallet-sized shipping systems. In either case, whether the shipping system is pallet-sized or parcel-sized, the shipping system typically includes a thermally insulated container having a space for receiving a temperature-sensitive material. In some cases, the temperature-sensitive material is placed within a product box (sometimes alternatively referred to as "a payload box"), which, in turn, is positioned within the space of the insulated container. Such a product box may be made of, for example, corrugated cardboard or the like and is often a six-sided rectangular structure having a top, a bottom, and four sides.

In addition, the shipping system also typically includes, usually within the insulated container, one or more passive temperature-control members consisting of or comprising a phase-change material. Examples of such passive temperature-control members may include, but are not limited to, the following: ice packs, gel packs, dry ice, loose pieces of frozen water (i.e., ice), combinations of the foregoing, or the like. Typically, the type of passive temperature-control member that is used is based, at least in part, on the temperature or temperature range at which one wishes to maintain the temperature-sensitive material in question. For example, when it is desired simply to maintain the material at a cold temperature, such as a temperature at or below 0° C., one may choose to use a frozen ice pack or loose pieces of ice as the passive temperature-control member. In fact, if no harm may come to the material even if subjected to temperatures considerably below 0° C., one may even choose to use passive temperature-control members like dry ice or solutions that have a solid/liquid transition temperature well below 0° C. (e.g., −20° C.).

On the other hand, when it is desired to maintain the temperature-sensitive material at a temperature above 0° C., such as within a temperature range of +2° C. to +8° C. (which is the desired temperature range for many pharmaceuticals and other temperature-sensitive items), the use of ice as a passive temperature-control member may be unsuitable as it may cause the payload to become too cold.

One way of addressing the foregoing problem has been to use, in the shipping system, a phase-change material having a solid/liquid transition temperature that is within the desired temperature range. For example, where the desired temperature range is +2° C. to +8° C., one may use a phase-change material having a solid/liquid transition temperature of approximately +5° C., such as n-tetradecane. Typically, in this scenario, the phase-change material having a solid/liquid transition temperature of approximately +5° C. is preconditioned at a temperature of approximately +3° C., whereby the aforementioned phase-change material is in a solid state. The solid phase-change material provides thermal protection to the payload against warm ambient temperatures by absorbing thermal energy first while warming from +3° C. to +5° C. and then while undergoing its solid to liquid phase transition at +5° C.

Another way of addressing the foregoing problem has been to use, in the shipping system, a combination of two different types of phase-change materials, namely, an aqueous phase-change material that has been preconditioned to a solid state, the aqueous phase-change material having a solid/liquid transition temperature that is below the desired temperature range, and an organic phase-change material that has been preconditioned to a liquid state, the organic phase-change material having a solid/liquid transition temperature that is within the desired temperature range.

An example of a shipping system of the above-mentioned type is the KoolTemp GTS Excel™ shipping system, which is commercially available from the present applicant, Cold Chain Technologies, LLC, Franklin, Mass. In one version, the aforementioned shipping system is designed to keep a payload within a temperature range of +2° C. to +8° C. for an extended period of time and includes an organic phase-change material having a solid/liquid transition temperature of approximately +3° C. The organic phase-change material, which is situated more proximal to the payload, is preconditioned to a liquid state, for example, by being placed in a refrigerator operating at a temperature of approximately +5° C. The aqueous phase-change material, which is situated more distal to the payload, has a solid/liquid transition temperature of 0° C. and is preconditioned to a solid state, for example, by being placed in a freezer operating at a temperature of approximately −20° C. In use, the organic phase-change material acts as a thermal buffer between the aqueous phase-change material and the payload, thereby keeping the payload from becoming too cold.

Still another way of addressing the foregoing problem has been to use, in the shipping system, a combination of two different types of phase-change materials, one of the phase-change materials being preconditioned to a liquid state and having a solid/liquid transition temperature at or near the minimum of the desired temperature range and the other phase-change material being preconditioned to a solid state and having a solid/liquid transition temperature at or near the maximum of the desired temperature range.

While shipping systems of the types described above have achieved some success in keeping a payload within a desired temperature range, such as +2° C. to +8° C., for an extended period of time, there is still some remove for improvement.

Documents that may be of interest may include the following, all of which are incorporated herein by reference: U.S. Pat. No. 5,899,088, inventor Purdum, issued May 4, 1999; U.S. Pat. No. 6,868,982 B2, inventor Gordon, issued Mar. 22, 2005; U.S. Pat. No. 7,908,870 B2, inventors Williams et al., issued Mar. 22, 2011; U.S. Pat. No. 8,250,882 B2, inventors Mustafa et al., issued Aug. 28, 2012; U.S. Pat. No. 9,045,278 B2, inventors Mustafa et al., issued Jun. 2, 2015; U.S. Pat. No. 9,180,998 B2, inventors Banks et al., issued Nov. 10, 2015; U.S. Pat. No. 10,583,978 B2, inventors Longley et al., issued Mar. 10, 2020; U.S. Pat. No. 10,604,326 B2, inventors Longley et al., issued Mar. 31, 2020; U.S. Pat. No. 10,661,969 B2, inventors Pranadi et al., issued May 26, 2020; U.S. Pat. No. 11,137,190 B2, inventor Martino, issued Oct. 5, 2021; U.S. Patent Application Publication No. US 2022/0002070 A1, inventors Moghaddas et al., published Jan. 6, 2022; U.S. Patent Application Publication No. US 2021/0024270 A1, inventor Mirzaee Kakhki, published Jan. 28, 2021; U.S. Patent Application Publication No. US 2020/0002075 A1, inventors Lee et al., published Jan. 2, 2020; U.S. Patent Application Publication No. US 2019/0210790 A1, inventors Rizzo et al., published Jul. 11, 2019; U.S. Patent Application Publication No. US 2018/0328644 A1, inventors Rizzo et al., published Nov. 15, 2018; and U.S. Patent Application Publication No. US 2018/0100682 A1, inventors Nilsen et al., published Apr. 12, 2018.

SUMMARY OF THE INVENTION

It is an object of the present invention to provide a novel shipping system for storing and/or transporting temperature-sensitive materials.

It is another object of the present invention to provide a shipping system as described above that overcomes at least some of the disadvantages associated with existing shipping systems.

It is still another object of the present invention to provide a shipping system as described above that has a minimal number of parts, that is easy to manufacture, and that is easy to use.

Therefore, according to one aspect of the invention, there is provided a passive temperature-control shipping system for use in keeping a payload within a desired temperature range for a period of time while exposed to an ambient environment outside of the desired temperature range, the passive temperature-control shipping system comprising (a) one or more thermal insulation members arranged to at least partially bound a space; (b) a first phase-change material associated with the one or more thermal insulation members, the first phase-change material having a phase-change temperature within the desired temperature range; and (c) a second phase-change material associated with the one or more thermal insulation members, the second phase-change material being physically discrete from the first phase-change material and having a phase-change temperature that is different than that of the first phase-change material; (d) wherein, when the system is adapted to receive the payload, both the first phase-change material and the second phase-change material are in a first phase that is different from a second phase in which the first and second phase-change materials exist when at equilibrium with the ambient environment.

In a more detailed feature of the invention, the ambient environment may be warmer than the desired temperature range, the phase-change temperature of the second phase-change material may be higher than the phase-change temperature of the first phase-change material, and the first phase may be a solid phase.

In a more detailed feature of the invention, the desired temperature range may be about +2° C. to +8° C.

In a more detailed feature of the invention, the phase-change temperature of the first phase-change material may be about +5° C.

In a more detailed feature of the invention, the phase-change temperature of the second phase-change material may be within the desired temperature range.

In a more detailed feature of the invention, the phase-change temperature of the second phase-change material may be about +7° C.

In a more detailed feature of the invention, the first phase change material and the second phase change material may be preconditioned to the solid phase in a first step at a temperature of minus 20° C. and then in a second step at a temperature of +3° C.

In a more detailed feature of the invention, the first phase-change material and the second phase-change material may be arranged in different planes, with the first phase-change material more proximal to the payload and with the second phase-change material more distal to the payload.

In a more detailed feature of the invention, the first phase-change material may be present in a greater mass, and the second phase-change material may be present in a lesser mass.

In a more detailed feature of the invention, the first phase-change material and the second phase-change material may be present in a 3:1 ratio by mass.

In a more detailed feature of the invention, the first phase-change material and the second phase-change material may be arranged coplanar.

In a more detailed feature of the invention, the first phase-change material and the second phase-change material may be arranged in different planes.

In a more detailed feature of the invention, the first phase-change material and the second phase-change material may be present in equal quantities.

In a more detailed feature of the invention, the first phase-change material and the second phase-change material may be present in unequal quantities.

In a more detailed feature of the invention, the passive temperature-control shipping system may be pallet-sized.

In a more detailed feature of the invention, the passive temperature-control shipping system may be parcel-sized.

In a more detailed feature of the invention, the passive temperature-control shipping system may be a pallet cover.

In a more detailed feature of the invention, the desired temperature range may be about +15° C. to +25° C.

In a more detailed feature of the invention, the desired temperature range may be about −25° C. to −15° C.

According to another aspect of the invention, there is provided a method of transporting and/or storing a payload comprising a temperature-sensitive material, the method comprising the steps of (a) providing a passive temperature-control shipping system as described above; (b) loading a payload into the passive temperature-control shipping system while both the first phase-change material and the second phase-change material are in the first phase; and (c) then, subjecting the passive temperature-control shipping system to the ambient environment outside of the desired temperature range.

In a more detailed feature of the invention, the method may further comprise the step of transporting the passive temperature-control shipping system.

In a more detailed feature of the invention, the method may further comprise, after step (c), hibernating the passive temperature-control shipping system at a temperature that is within the desired temperature range and that is between the phase-change temperature of the first phase-change material and the phase-change temperature of the second phase-change material.

In a more detailed feature of the invention, the method may further comprise, after the hibernating step, again subjecting the passive temperature-control shipping system to the ambient environment outside of the desired temperature range.

In a more detailed feature of the invention, the ambient environment may be warmer than the desired temperature range, the phase-change temperature of the second phase-change material may be higher than the phase-change temperature of the first phase-change material, and the first phase may be a solid phase.

In a more detailed feature of the invention, the desired temperature range may be about +2° C. to +8° C.

In a more detailed feature of the invention, the phase-change temperature of the first phase-change material may be about +5° C.

In a more detailed feature of the invention, the phase-change temperature of the second phase-change material may be within the desired temperature range.

In a more detailed feature of the invention, the phase-change temperature of the second phase-change material may be about +7° C.

In a more detailed feature of the invention, the first phase change material and the second phase change material may be preconditioned to the solid phase in a first step at a temperature of minus 20° C. and then in a second step at a temperature of +3° C.

In a more detailed feature of the invention, the first phase-change material and the second phase-change material may be arranged in different planes, with the first phase-change material more proximal to the payload and with the second phase-change material more distal to the payload.

In a more detailed feature of the invention, the first phase-change material may be present in a greater mass, and the second phase-change material may be present in a lesser mass.

In a more detailed feature of the invention, the first phase-change material and the second phase-change material may be present in a 3:1 ratio by mass.

According to yet another aspect of the invention, there is provided a method of transporting and/or storing a payload comprising a temperature-sensitive material, the method comprising the steps of (a) providing one or more thermal insulating members; (b) providing a first phase-change material, the first phase-change material having a phase-change temperature that is within a range of about +2° C. to +8° C.; (c) providing a second phase-change material, the second phase-change material having a phase-change temperature that is greater than that of the first phase-change material; (d) conditioning both the first phase-change material and the second phase-change material at a temperature at which both are in a solid phase; (e) associating the first phase-change material and the second phase-change material with the one or more thermal insulation members to form a system having a payload space; (f) loading the payload into the payload space while the first phase change material and the second phase change material are solid; (g) then, subjecting the system to an ambient environment that is warmer than +8° C.; and (h) then, hibernating the system at a temperature that is at or above the phase-change temperature of the first phase-change material, that is below the phase-change temperature of the second phase-change material, and that is within the range of about +2° C. to +8° C.

In a more detailed feature of the invention, the method may further comprise, after the hibernating step, once again subjecting the system to the ambient environment that is warmer than +8° C.

In a more detailed feature of the invention, the phase-change temperature of the first phase-change material may be about +5° C., and the phase-change temperature of the second phase-change material may be about +7° C.

In a more detailed feature of the invention, the conditioning step may comprise subjecting the first phase change material and the second phase change material to a first conditioning temperature of minus 20° C. and then to a second conditioning temperature of +3° C.

For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. These drawings are not necessarily drawn to scale, and certain components may have undersized and/or oversized dimensions for purposes of explication. In the drawings wherein like reference numerals represent like parts.

DETAILED DESCRIPTION OF THE INVENTION

Figure 1:
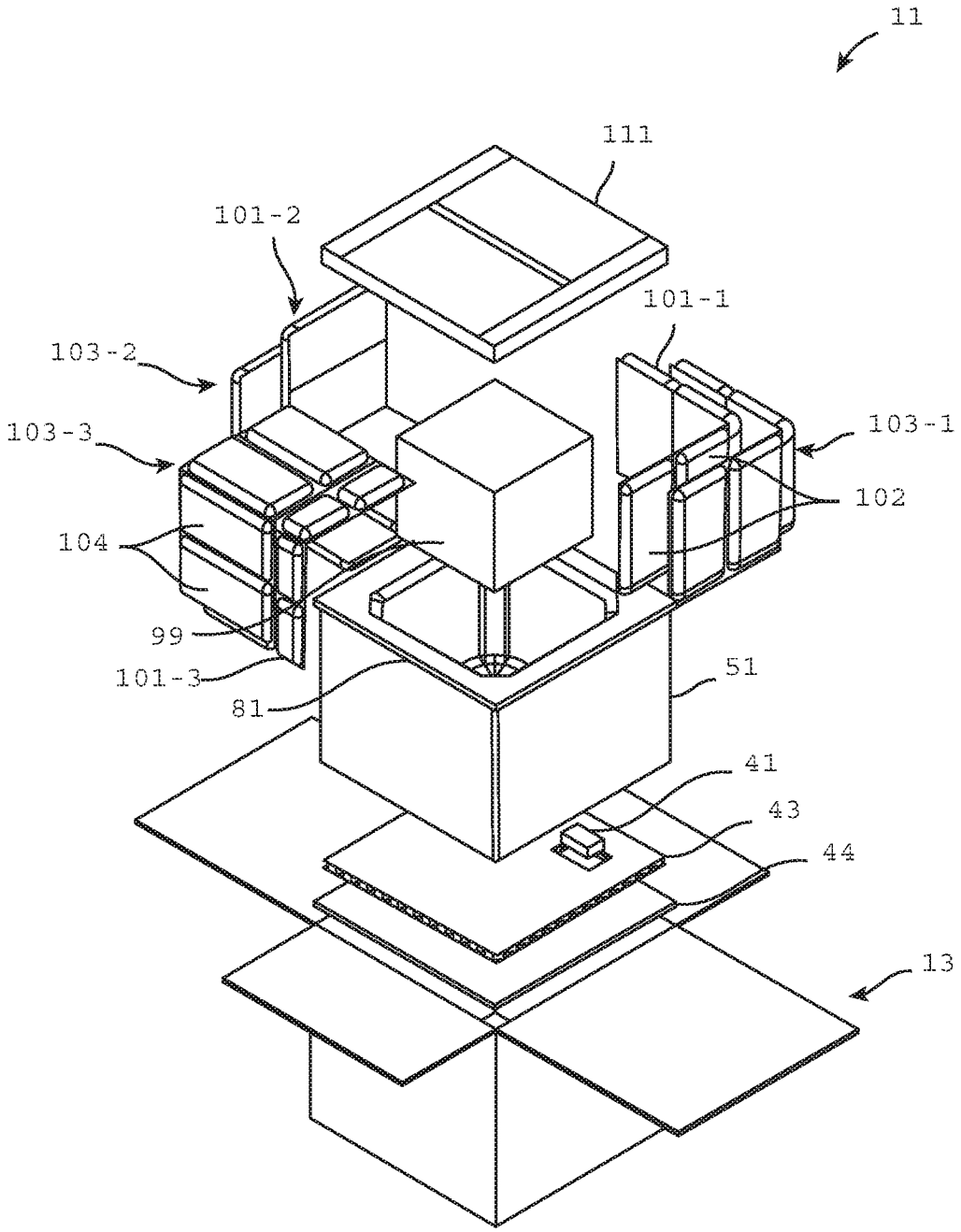
FIG. 1 is a partly exploded perspective view of a first embodiment of a shipping system suitable for use in storing and/or transporting temperature-sensitive materials, the shipping system being constructed according to the present invention, with the cover of the lid assembly not being shown.
Figure 2:
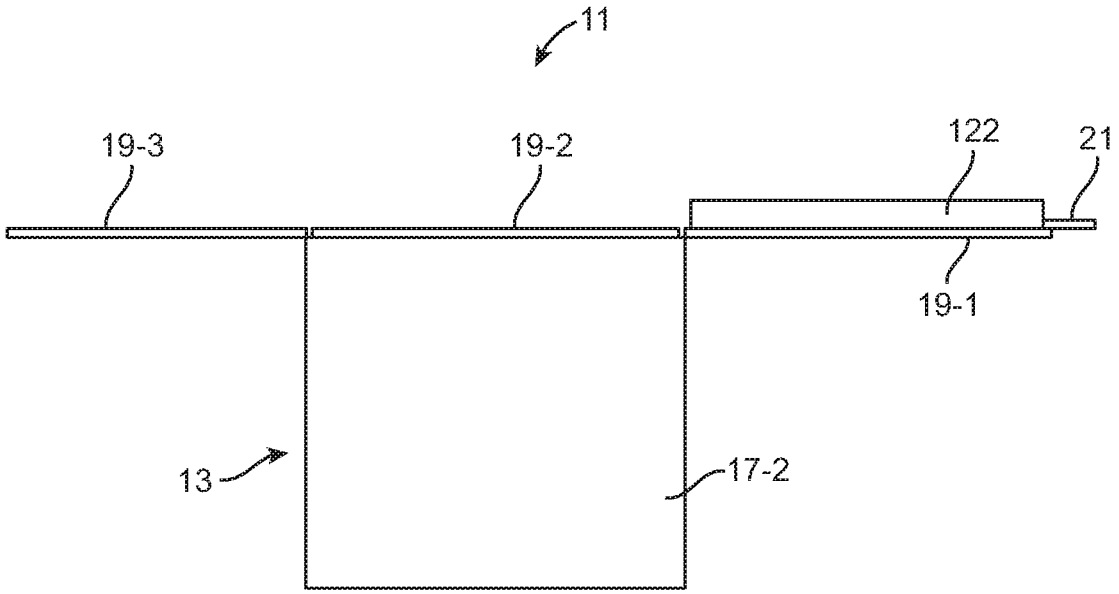
FIG. 2 is a side view of the shipping system shown in FIG. 1, with the top flaps of the outer container being shown in an open state.
Figure 3:
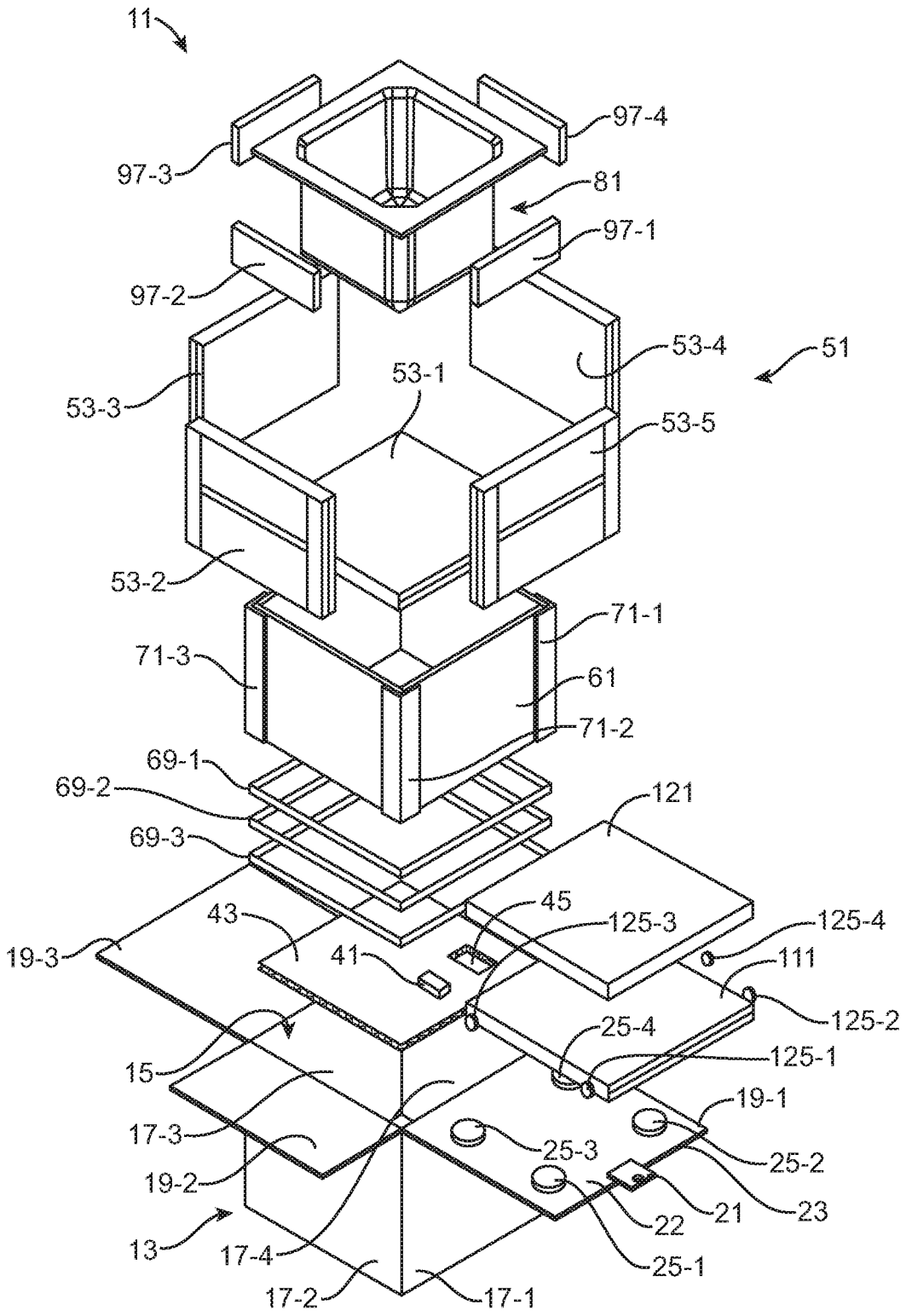
FIG. 3 is a partly exploded perspective view of the shipping system shown in FIG. 1, with the payload container, the bottom pad, and the temperature-control members not being shown.

The present invention is based, at least in part, on the surprising discovery that a shipping system exhibiting markedly superior thermal protection properties can be obtained by using particular combinations of physically discrete (i.e., unmixed) phase-change materials. In at least one embodiment, the shipping system may be designed to keep a payload within a desired temperature range for an extended period of time, wherein the desired temperature range could be, for example, (i) +2° C. to +8° C.; (ii) +15° C. to +25° C.; or (iii) −25° C. to −15° C., and the shipping system may demonstrate an extended duration of thermal protection within the desired temperature range by using particular combinations of two or more phase-change materials, the two or more phase-change materials having different phase transition temperatures.

In at least one embodiment, at the time of pack-out (i.e., deployment in the shipping system, together with the payload), all, or at least two, of the two or more phase-change materials may be in the same physical state (e.g., all, or at least two, of the two or more phase-change materials may be solid or all, or at least two, of the two or more phase-change materials may be liquid). Following pack-out, the shipping system may be exposed to ambient temperatures external to the shipping system that may cause the phase-change materials to transition towards a phase change. For example, where all of the two or more phase-change are initially solid and preconditioned to a temperature below their solid/liquid transition temperatures, upon exposure to a warm ambient temperature, such phase-change materials may rise in temperature and, in some cases, may transition from solid to liquid. Preferably, the phase-change materials are selected so that, following the aforementioned movement towards a phase change, if the shipping system is then subjected, during an interim period, to an ambient temperature that is intermediate to the phase transition temperatures of the phase-change materials, one of the phase-change materials reverses the direction of its phase change (e.g., re-freezes in the case where the phase-change material had previously melted from a preconditioned solid or re-melts in the case where the phase-change material had previously frozen from a preconditioned liquid) while the other phase-change material continues to change phase (i.e., continues to move in its original melting or freezing direction) or stops changing phase altogether. In the above manner, the phase-change material that reverses its phase-change, during the interim period, is effectively re-charged to provide additional thermal protection to the payload when, after the interim period, the shipping system is again subjected to ambient temperatures of the type originally experienced.

As noted above, in at least one embodiment, each of the two or more phase-change materials may be in a solid state at the time of initial pack-out, or each of the two or more phase-change materials may be in a liquid state at the time of initial pack-out. In at least one embodiment, for example, where the shipping system is designed to keep its payload within a temperature range of +2° C. to +8° C., one of the at least two phase-change materials may have a solid/liquid transition temperature at or below a refrigerating hibernation temperature of approximately +5° C. to +6° C., and another of the at least two phase-change materials may have a solid/liquid transition temperature above the aforementioned refrigerating hibernation temperature. (For purposes of the present application, "hibernation" refers to the temporary storage of a shipping system in an active temperature-control device, such as an electrically-powered refrigerator or an electrically-powered freezer, while the shipping system is in transit from its origin to its destination. Hibernation may occur, for example, by temporarily placing the shipping system in the active temperature-control device while the shipping system is being processed at customs.) In at least one embodiment, where hibernation takes place at approximately +5° C. to +6° C., one of the at least two phase-change materials may have a solid/liquid transition temperature at or below approximately +5° C. to +6° C., and another of the at least two phase-change materials may have a solid/liquid transition temperature above approximately +5° C. to +6° C.

The respective quantities or masses of the at least two phase-change materials in the shipping system may be equal or unequal. For example, in one embodiment, the quantity or mass of a first phase-change material may be greater than the quantity or mass of a second phase-change material. Each of the at least two phase-change materials may be evenly or unevenly distributed around the payload, and the distribution of phase-change material around the payload may be the same or different for each of the at least two phase-change materials. The at least two phase-change materials may be located in the same plane as one another, or the at least two phase-change materials may be located in different planes from one another. For example, where the at least two phase-change materials are located in different planes from one another, one of the at least two phase-change materials may be located more proximal to the payload, and another of the at least two phase-change materials may be located more distal to the payload.

Set forth below are illustrative embodiments of a shipping system of the present invention. Such illustrative embodiments are not to be taken as defining or limiting the scope of the present invention.

Referring now to FIGS. 1, 2, 3, 4A, and 4B, there are shown various views of a first embodiment of a shipping system suitable for use in storing and/or transporting temperature-sensitive materials, the shipping system being constructed according to the present invention and being represented generally by reference numeral 11. For clarity and/or ease of illustration, certain details of shipping system 11 that are discussed elsewhere in this application or that are not critical to an understanding of the invention may be omitted from one or more of FIGS. 1, 2, 3, 4A and 4B or may be shown therein in a simplified manner.

System 11 may be used to maintain a payload within a desired temperature range for an extended period of time.

Solely for illustrative purposes and not to be limited thereto, system 11 may be configured to maintain a parcel-sized payload within a temperature range of +2° C. to +8° C. for an extended period of time, for example, up to 96 hours or longer without hibernation, and even longer with hibernation, as discussed further below.

System 11 may comprise an outer box 13. Outer box 13, which may be, for example, a conventional corrugated cardboard box or carton, may comprise a rectangular prismatic cavity 15 bounded by a plurality of rectangular side walls 17-1 through 17-4, a plurality of bottom closure flaps (not shown), and a plurality of top closure flaps 19-1 through 19-4. Adhesive strips of tape or other closure means (not shown) may be used to retain, in a closed condition, the bottom closure flaps and top closure flaps 19-1 through 19-4.

A tab 21 (see FIGS. 2 and 3) may be secured, for example, by adhesive or similar means, to an interior face 22 of top closure flap 19-1, and tab 21 may be situated on interior face 22 so as to extend across a free edge 23 of top closure flap 19-1. In this manner, a user may swing open top closure flap 19-1 from a closed state by pulling generally upwardly on tab 21. Tab 21 may be made of a sheet of polymeric material, such as a polyvinyl chloride or similar material. Instead of being secured to closure flap 19-1, tab 21 may be secured to an insulated lid assembly mounted on closure flap 19-1.

A plurality of fasteners 25-1 through 25-4 may be secured, for example, by an adhesive or similar means to interior face 22 of top closure flap 19-1. As will be discussed further below, fasteners 25-1 through 25-4 may be used to removably couple a vacuum insulated panel (VIP) to top closure flap 19-1. In the present embodiment, fasteners 25-1 through 25-4 may be hook (or loop) fasteners, with complementary loop (or hook) fasteners being secured, for example, by adhesive or similar means to the vacuum insulated panel; however, it is to be understood that other types of fasteners, such as adhesive fasteners applied to one or both of the vacuum insulated panel and top closure flap 19-1, may also be used. Also, although four fasteners 25-1 through 25-4 are shown in the present embodiment, it is to be understood that a greater number or lesser number of fasteners 25-1 through 25-4 may be used without departing from the present invention.

Figure 5:
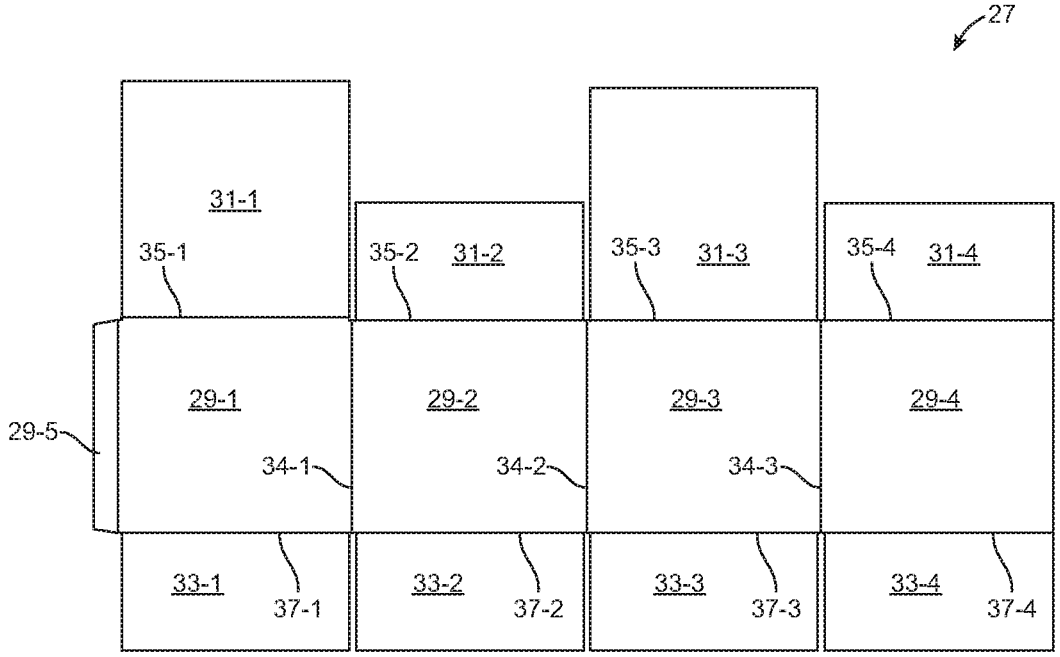
FIG. 5 is a top view of a blank used to make the outer box shown in FIG. 1.

Referring now to FIG. 5, there is shown a blank 27, which may be used to form outer box 13. Blank 27, which may be a unitary structure made of corrugated cardboard or a similar material, may be cut and scored to define a plurality of central panels 29-1 through 29-5, a plurality of top panels 31-1 through 31-4, and a plurality of bottom panels 33-1 through 33-4. Central panels 29-1 through 29-4 may be folded about lines 34-1 to 34-3 to become side walls 17-1 through 17-4 of outer box 13, and central panel 29-5 may be used to secure central panel 29-1 to central panel 29-4 using an adhesive (not shown) or the like. Top panels 31-1 through 31-4 may be folded about lines 35-1 through 35-4, respectively, to become top flaps 19-1 through 19-4, respectively, of outer box 13. Bottom panels 33-1 through 33-4 may be folded about lines 37-1 through 37-4, respectively, to become the bottom flaps of outer box 13.

Notwithstanding the above, outer box 13 may be omitted from system 11.

Referring back now to FIGS. 1 and 3, system 11 may also comprise an environmental data logger 41. Environmental data logger 41 may be, for example, a conventional temperature data logger that may be configured to measure and to store the ambient external temperature to which system 11 is exposed over an extended period of time. Additionally or alternatively, environmental data logger 41 may be configured to measure or to detect and, optionally, to store one or more of shock/movement, global position, moisture/humidity, or some other environmental parameter.

Figure 6:
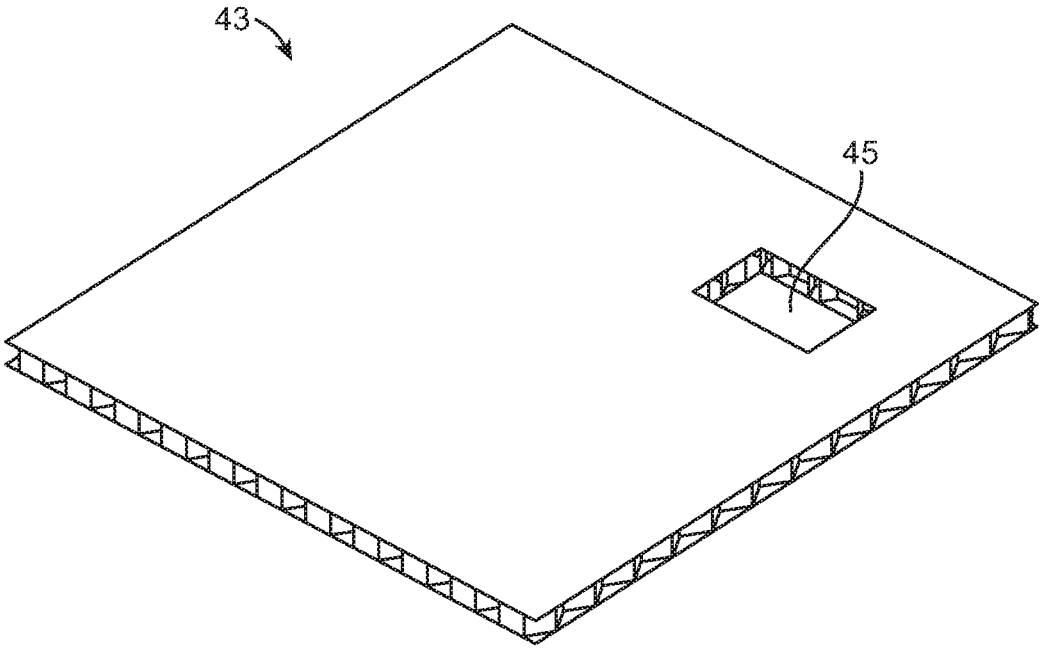
FIG. 6 is an enlarged perspective view of the data logger board shown in FIG. 3.

System 11 may additionally comprise a board 43, which is also shown separately in FIG. 6. Board 43, which may be, for example, a piece of honeycomb corrugated cardboard, may be shaped to include a transverse opening 45. Opening 45 may be appropriately dimensioned to receive data logger 41. In particular, opening 45 may be dimensioned to have a length and a width to snugly receive data logger 41. Preferably, board 43 has a thickness that is approximately equal to or slightly greater than that of data logger 41. Accordingly, in the present embodiment, data logger 41 may have a thickness of approximately 0.4 inch, and board 43 may have a thickness of approximately 0.5 inch. In addition, board 43 preferably has a length and a width that are slightly less than those of prismatic cavity 15 of outer box 13 to enable board 43 to be placed horizontally within prismatic cavity 15 of outer box 13.

Notwithstanding the above, environmental data logger 41 and/or board 43 may be omitted from system 11.

System 11 may also include a foam pad 44, which may be made of a polyurethane or the like, positioned between board 43 and the bottom closure flaps of outer box 13. Foam pad 44 may serve to keep the components that are contained within outer box 13 from jostling up and down, despite tolerances, and may also provide some shock absorption to protect the contents disposed within outer box 13.

Notwithstanding the above, foam pad 44 may be omitted from system 11.

Figure 7:
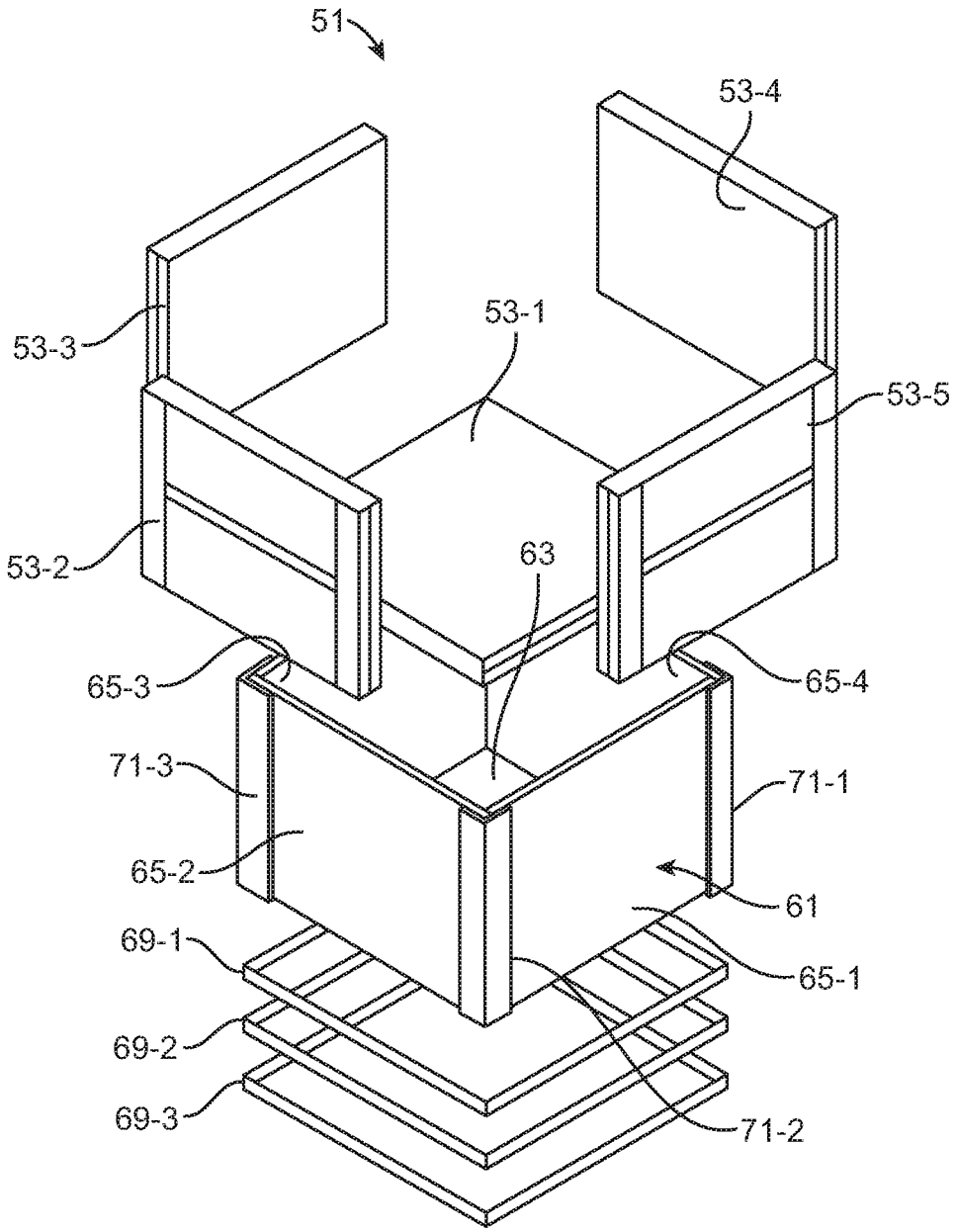
FIG. 7 is a partly exploded perspective view of the insulation unit shown in FIG. 3.
Figure 8:
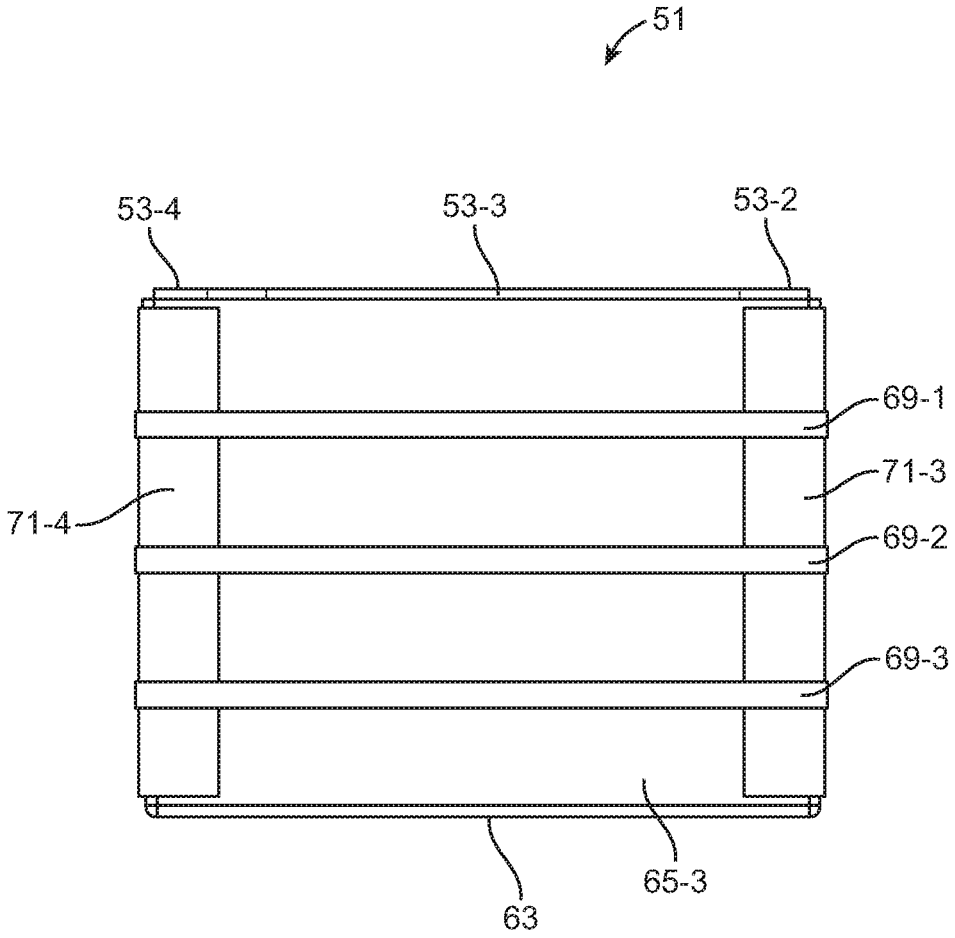
FIG. 8 is a rear view, showing the insulation unit of FIG. 7 in an assembled state.

System 11 may further comprise an insulation unit 51. Insulation unit 51, which is also shown separately in FIGS. 7 and 8, may comprise a plurality of vacuum insulated panels 53-1 through 53-5, which may be similar or identical to one another. Vacuum insulated panels 53-1 through 53-5, which may be conventional vacuum insulated panels, may be arranged with vacuum insulated panels 53-2 through 53-5 positioned perpendicularly relative to and sitting directly on top of vacuum insulated panel 53-1 so as to define a generally prismatic cavity bounded by a bottom wall and four side walls. The four side walls may be positioned relative to one another in a "pinwheel"-type arrangement, wherein one end of each vacuum insulated panel abuts the inside major surface of its adjacent vacuum insulated panel. Alternatively, the four side walls may be positioned relative to one another so that one end of each of two parallel vacuum insulated panels abuts the inside major surface of each of the two remaining parallel vacuum insulated panels.

Figure 9:
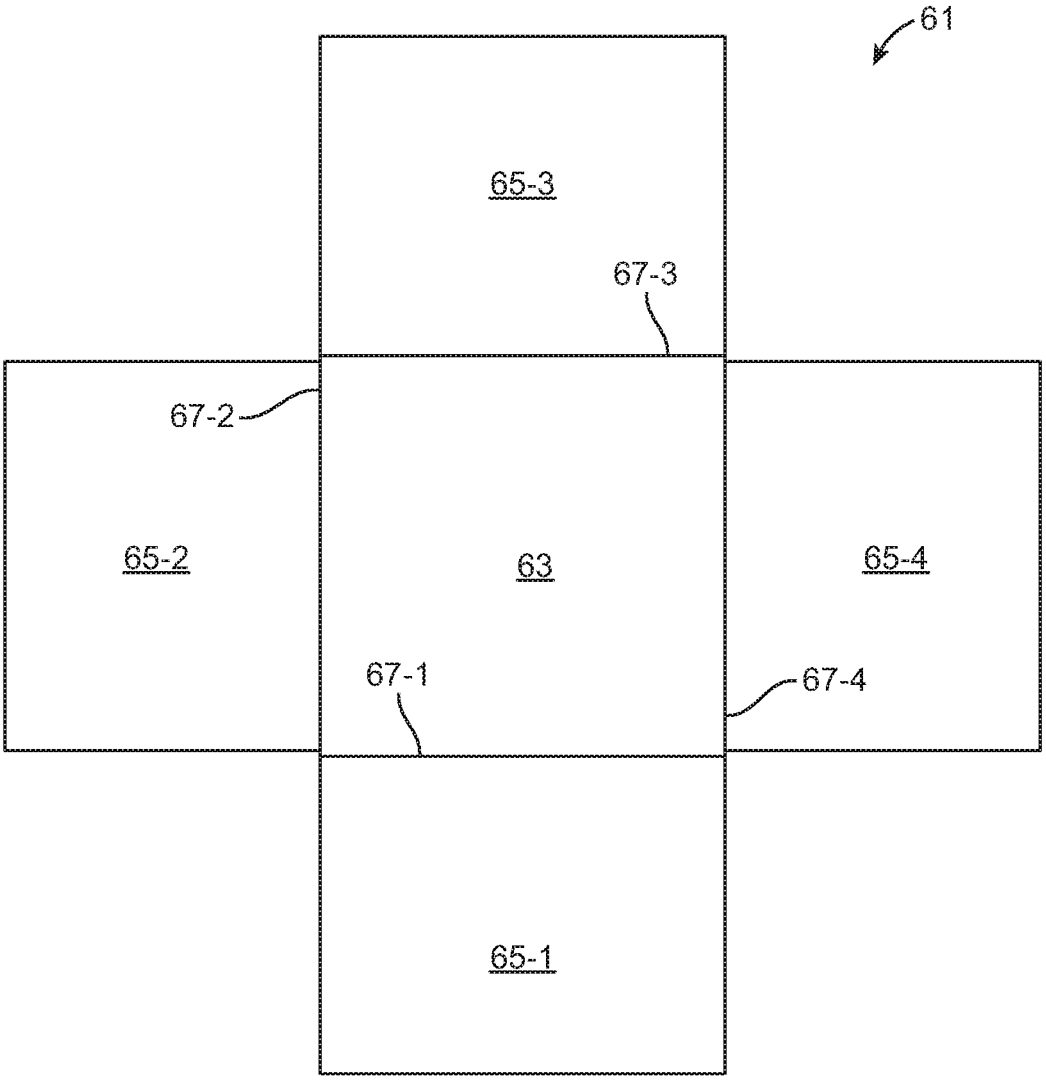
FIG. 9 is an enlarged top view of the support shown in FIG. 3, the support being shown in an unfolded state.

Insulation unit 51 may additionally comprise a support 61, which is also shown separately in FIG. 9 in an unfolded state. Support 61, which may be made of corrugated cardboard or the like, may be a unitary box-like structure configured to include a central portion 63 and four side portions 65-1 through 65-4. Central portion 63 may be rectangular, and each of four side portions 65-1 through 65-4 may extend from a different one of the four sides of the central portion 63. Support 61 may be folded along edges 67-1 through 67-4 and may be appropriately dimensioned so that the central portion 63 of support 61 may be positioned under vacuum insulated panel 53-1 and so that side portions 65-1 through 65-4 of support 61 may be positioned along the outside faces of vacuum insulated panels 53-2 through 53-5, as well as along the peripheral edges of vacuum insulated panel 53-1. As will be discussed further below, support 61 may be used, in conjunction with other structural members, to help keep vacuum insulation panels 53-1 through 53-5 assembled together. In addition, support 61 may also provide some additional thermal insulation to insulation unit 51.

Insulation unit 51 may further comprise a plurality of plastic binding straps 69-1 through 69-3. Straps 69-1 through 69-3, which may be conventional binding straps, may be wrapped around the four sides of support 61 and may be used to help retain vacuum insulated panels 53-1 through 53-5 in an assembled state.

Figure 10A:
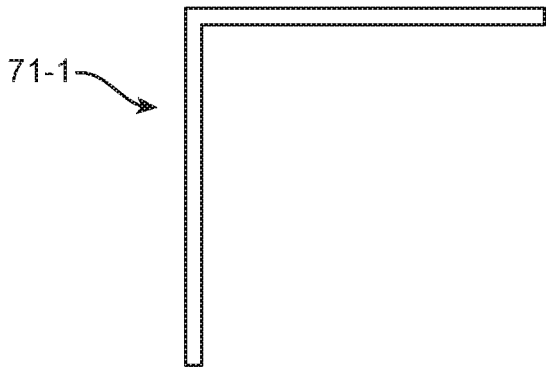
FIGS. 10A and 10B are enlarged side and enlarged perspective views, respectively, of one of the corner boards shown in FIG. 3.
Figure 10B:
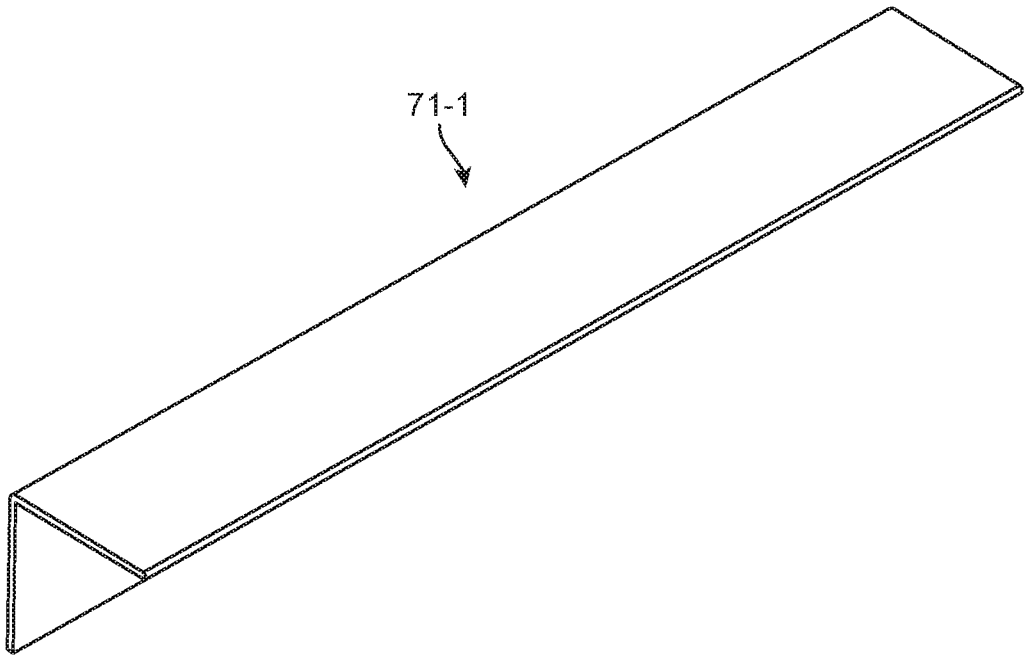
Figure 11A:
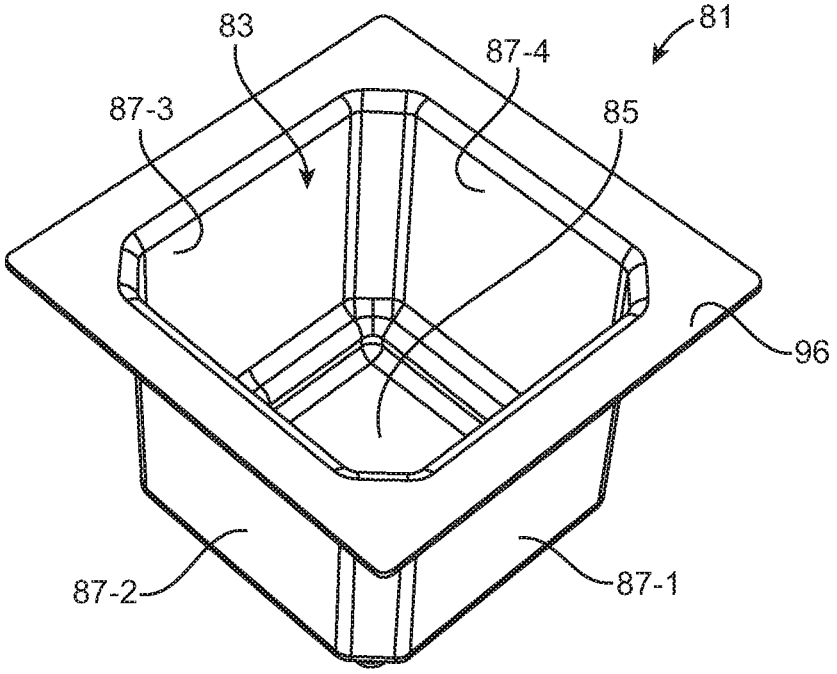
FIGS. 11A and 11B are perspective and top views, respectively, of the liner shown in FIG. 1.
Figure 11B:
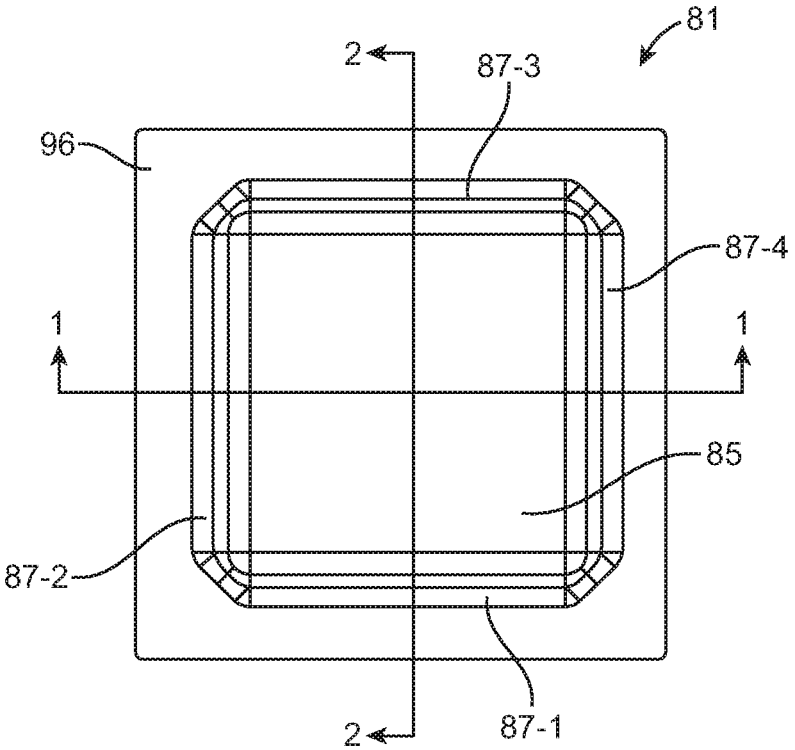
Figure 11C:
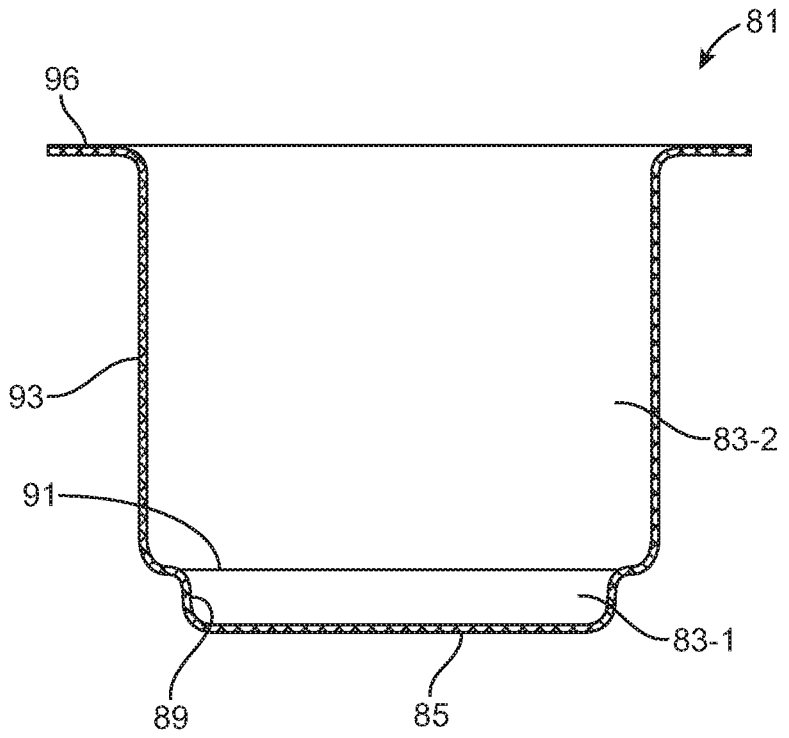
FIGS. 11C and 11D are section views taken along lines 1-1 and 2-2, respectively, of FIG. 11B.
Figure 11D:
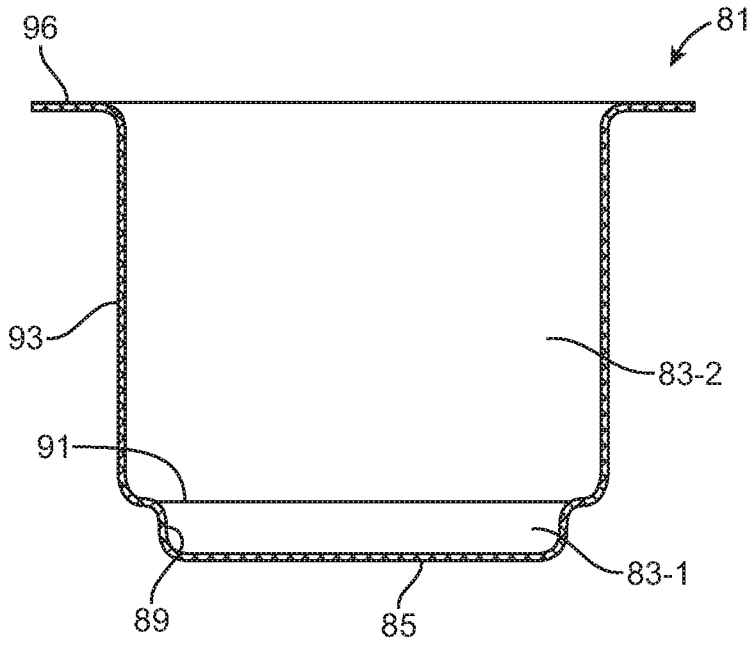

Insulation unit 51 may further comprise a plurality of corner boards 71-1 through 71-4. Corner boards 71-1 through 71-4 may be identical to one another (corner board 71-1 being shown separately in FIGS. 10A and 10B). Corner boards 71-1 through 71-4 may be made of Kraft paper and may have a thickness, for example, of 0.06 to 0.08 inch. Corner boards 71-1 through 71-4 may be positioned vertically at the four exterior corners of support 61 and may help to increase the thermal life of insulation unit 51 by keeping panels 53-1 through 53-5 together and tighter for a longer period of time and by protecting support 61 and panels 53-1 through 53-5 from physical damage that may be caused by straps 69-1 through 69-3, particularly at the four corners of insulation unit 51. Corner boards 71-1 through 71-4 also may help to increase the length of time that straps 69-1 through 69-3 are able to hold a minimal required tension in a reuse application.

Insulation unit 51 may be assembled as follows: First, support 61 may be folded and then placed in a fixture (not shown), whereby side portions 65-1 through 65-4 may be maintained in a generally perpendicular orientation relative to central portion 63. Next, panel 53-1 may be positioned with its bottom major surface flush on top of central portion 63. Next, panels 53-2 through 53-5 may be positioned on top of panel 53-1 in a "pinwheel" arrangement. (Preferably, the seams of panels 53-1 through 53-5 face outwardly towards support 61.) Next, corner boards 71-1 through 71-4 may be placed around the exterior four corners of the support 61. Next, straps 69-1 through 69-3 may be wrapped around support 61 and corner boards 71-1 through 71-4. (Preferably, each of straps 69-1 through 69-3 provides a tension of at least 10 psi.) The resulting structure is a five-sided unit defining a cavity bounded by a bottom and four sides and having an open top. As can be appreciated, in the absence of the combination of support 61, straps 69-1 through 69-3, and corner boards 71-1 through 71-4, there is nothing keeping panels 53-1 through 53-5 in an assembled state.

It is to be understood that, although the insulation unit of the present embodiment is shown as comprising a plurality of vacuum insulated panels, said insulation unit need not comprise a plurality of vacuum insulated panels and could, for example, consist of or comprise a single vacuum insulated panel that is shaped to define a cavity of an appropriate shape and size. Moreover, in other embodiments, insulation unit 51 need not comprise any vacuum insulated panels and, instead, may consist of or comprise one or more other types of thermal insulation arranged to define a cavity of appropriate shape and size. Such alternative forms of thermal insulation may comprise panels or unitary structures consisting of or comprising expanded polystyrene, polyurethane foam, or the like.

Referring back now to FIGS. 1 and 3, system 11 may further comprise a protective liner (or shell or insert) 81, which is also shown separately in FIGS. 11A through 11D. Liner 81, which is appropriately dimensioned to be removably mounted on insulation unit 51, may be a rigid structure, either one-piece or multi-piece, consisting of or comprising materials, such as a thermoformed plastic (e.g., high density polyethylene having a thickness of approximately 0.1 inch), a corrugated cardboard or plastic, polyester paper, expanded polypropylene (EPP), polyethylene terephthalate (PET), plastic corrugate panels, or some combination thereof. Alternatively, liner 81 may consist of or comprise a polymer-coated corrugated cardboard, such as a polyurea-coated corrugated cardboard or a polyurethane-coated corrugated cardboard. In the present embodiment, liner 81 may be a one-piece thermoformed member shaped to include a cavity 83 bounded by a bottom wall 85 and four side walls 87-1 through 87-4. Each of side walls 87-1 through 87-4 may include a lower portion 89, an intermediate portion 91, and an upper portion 93. Lower portion 89 and upper portion 93 may extend generally vertically (although there may be a draft angle where liner 81 is made by thermoforming), with lower portion 89 being spaced inwardly relative to upper portion 93 and with intermediate portion 91 extending generally horizontally. In this manner, cavity 83 may be regarded as having a lower portion 83-1 of relatively smaller footprint and an upper portion 83-2 of relatively larger footprint 83-2, with intermediate portion 91 forming a shelf at the bottom of upper portion 83-2. Liner 81 is preferably dimensioned so that bottom wall 85 and side walls 87-1 through 87-4 may be inserted into the cavity of insulation unit 51, with bottom wall 85 being positioned over the top of vacuum insulated panel 53-1 and with side walls 87-1 through 87-4 being positioned along the inner faces of vacuum insulated panels 53-2 through 53-5. A flange 96 may extend peripherally outwardly from the open top of liner 81 and may be dimensioned to sit on top of and to cover the tops of vacuum insulated panels 53-2 through 53-5. In this manner, liner 81 may cover the exposed inner and top faces of vacuum insulated panels 53-2 through 53-5. Liner 81 may be dimensioned so that bottom wall 85 of liner 81 is spaced from the bottom vacuum insulated panel 53-1, for example, by approximately ⅛-¼ inch, whereby an air gap is provided between the bottom of liner 81 and panel 53-1. This may be done to allow for tolerances of liner 81.

System 11 may further comprise a plurality of foam pads 97-1 through 97-4. Pads 97-1 through 97-4, which may be identical to one another, may be made of an open cell urethane or similar material. Pads 97-1 through 97-4 may be fixedly mounted, for example, with an adhesive (not shown), on the outside surfaces of side walls 87-1 through 87-4, respectively, of liner 81, preferably on upper portion 93 of side walls 87-1 through 87-4. Pads 97-1 through 97-4 may serve to keep liner 81 from moving laterally relative to the remainder of insulation unit 51. In this manner, damage to outer box 13 by flange 96 may be reduced. Pads 97-1 through 97-4 may also provide some nominal thermal insulation.

It is to be understood that, although system 11 is shown as including liner 81 and foam pads 97-1 through 97-4, liner 81 and foam pads 97-1 through 97-4 may be omitted from system 11. Additionally, liner 81 and foam pads 97-1 through 97-4 could be replaced with liner assembly 81 of U.S. Patent Application Publication No. US 2022/0002070 A1, inventors Moghaddas et al., published Jan. 6, 2022, or with any other type of suitable liner.

System 11 may further comprise a product box 99, in which the temperature-sensitive materials (not shown) may be disposed. Product box 99, which may be a conventional corrugated cardboard box, may be appropriately dimensioned to be received within cavity 83 of liner 81. In the present embodiment, product box 99 may be dimensioned to hold a payload volume of approximately 6 L.

System 11 may further comprise a first plurality of temperature-control members 101-1 through 101-3 and a second plurality of temperature-control members 103-1 through 103-3. Subject to the compositional requirements detailed below, materials suitable for use as first plurality of temperature-control members 101-1 through 101-3 and second plurality of temperature-control members 103-1 through 103-3 may include flexible mats containing phase-change material of the type disclosed in U.S. Pat. No. 9,598,622 B2, inventors Formato et al., issued Mar. 21, 2017; U.S. Patent Application Publication No. US 2018/0093816 A1, inventors Longley et al., published Apr. 5, 2018; and U.S. Patent Application Publication No. US 2019/0210790 A1, inventors Rizzo et al., published Jul. 11, 2019, all of which are incorporated herein by reference. Notwithstanding the above, it is to be understood that, instead of using flexible mats containing phase-change material for temperature-control members 101-1 through 101-3 and 103-1 through 103-3, as in the present embodiment, one could, instead, use temperature-control members of other physical forms, such as an appropriate number of rigid bottles or panels containing phase-change material, wherein each such bottle or panel faces a single side or multiple sides of a payload.

Figure 4A:
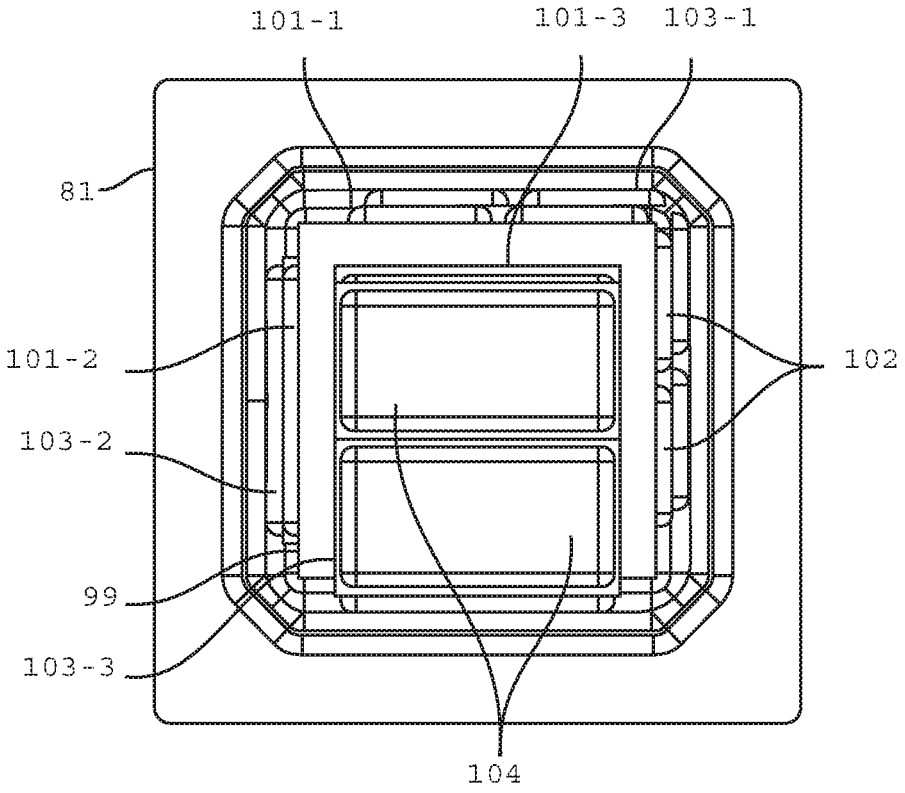
FIGS. 4A and 4B are top and section views, respectively, of the shipping system of FIG. 1, with only the liner, the product box, and the temperature-control members being shown.
Figure 4B:
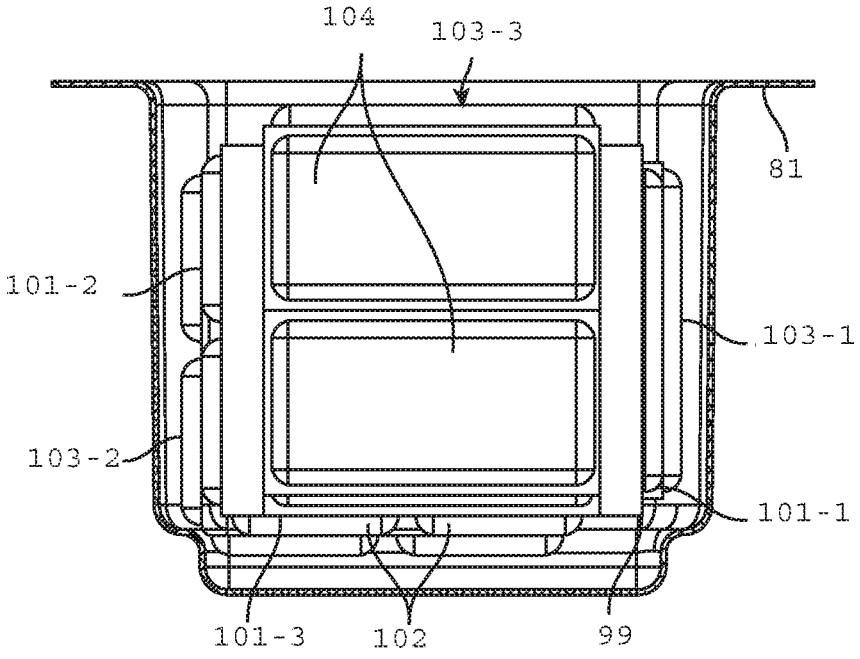

As can be seen in FIGS. 1, 4A, and 4B, first plurality of temperature-control members 101-1 through 101-3 may be arranged around product box 99 so as to be comparatively more proximal to product box 99, and second plurality of temperature-control members 103-1 through 103-3 may be arranged around product box 99 so as to be comparatively more distal to product box 99. Thus, temperature-control members 101-1 through 101-3 may be regarded as "inner" temperature-control members, and temperature-control members 103-1 through 103-3 may be regarded as "outer" temperature-control members.

In the present embodiment, each of inner temperature-control members 101-1 through 101-3 may have four generally rectangular, trough-shaped pouches 102, and each of outer temperature-control members 103-1 through 103-3 may have four generally rectangular, trough-shaped pouches 104. Inner temperature-control members 101-1 through 101-3 may be arranged around product box 99 so that two pouches 102 of inner temperature-control members 101-1 through 101-3 may face each side of product box 99. Outer temperature-control members 103-1 through 103-3 may be similarly arranged around inner temperature-control members 101-1 through 101-3. Preferably, inner temperature-control members 101-1 through 101-3 and outer temperature-control members 103-1 through 103-3 are dimensioned to snugly fit between product box 99 and protective liner 81. Notwithstanding the above, it is to be understood that the number and/or dimensions of inner temperature-control members 101-1 through 101-3 and outer temperature-control members 103-1 through 103-3, as well as the number of pouches 102 and 104 therein and their fit between product box 99 and protective liner 81, may be varied without departing from the present invention.

In the present embodiment, each of inner temperature-control members 101-1 through 101-3 may contain a first type of phase-change material, and each outer temperature-control members 103-1 through 103-3 may contain a second type of phase-change material that is different from the first type of phase-change material, the first and second types of phase-change material having different phase change (e.g., solid/liquid) temperatures. In the present embodiment, each pouch 102 may contain the same quantity of the first phase-change material, and each pouch 104 may contain the same quantity of the second phase-change material; however, this need not be the case. Moreover, the quantity of first phase-change material contained in each pouch 102 may be the same as the quantity of second phase-change material contained in each pouch 104, but this also need not be the case. In fact, in some cases, the quantity of first phase-change material in each pouch 102 may be considerably more than, or may be considerably less than, the quantity of second phase-change material in each pouch 104. In some cases, the first phase-change material may have a lower phase-change temperature than the second phase-change material whereas, in other cases, the first phase-change material may have a higher phase-change temperature than the second phase-change material. As will be discussed further below, at the time of pack-out, both the first phase-change material and the second phase-change material are preferably preconditioned to the same state (e.g., both solid or both liquid), and both the first phase-change material and the second phase-change material may be preconditioned to be at the same temperature.

Where, for example, system 11 is intended to keep a payload within a desired temperature range of +2° C. to +8° C. under summer-like conditions (i.e., ambient temperatures considerably greater than the aforementioned desired temperature range) and with an expected hibernation somewhere within the aforementioned desired temperature range, one of the phase-change materials may have a phase-change temperature that is at or below the hibernation temperature (and preferably, but not necessarily, above the minimum temperature of the desired temperature range), and the other phase-change material may have a phase-change temperature that is above the hibernation temperature (and preferably, but not necessarily, below the maximum temperature of the desired temperature range). In such a case, both phase-change materials are preferably preconditioned to be solid at the time of pack-out. In addition, the phase-change material having the lower phase-change temperature may be positioned more proximal to product box 99 (i.e., in pouches 102), and the phase-change material having the higher phase-change temperature may be positioned more distal to product box 99 (i.e., in pouches 104).

Analogous considerations may be applied to selecting appropriate phase-change materials for other desired temperature ranges, the selected phase-change materials preferably having phase-change transition temperatures such that, when system 11 is placed into hibernation, one of the phase-change materials reverses the direction of its phase change while the other phase-change material continues to change phase in the original direction or stops changing phase altogether.

With the above considerations in mind, various types of water-based phase-change materials and/or organic phase-change materials may be suitable for use as the phase-change materials. For example, where system 11 is intended to keep a payload within a desired temperature range of +2° C. to +8° C. under summer-like conditions and with an expected hibernation of approximately +5° C. to +6° C., one could use, as the two phase-change materials, a gelled organic phase-change material having a +5° C. phase-change temperature and a gelled organic phase-change material having a +7° C. phase-change temperature of the types disclosed in U.S. Pat. No. 9,598,622 B2 and U.S. Patent Application Publication No. US 2018/0093816 A1. One may precondition the +5° C. phase-change material and a +7° C. phase-change material so that they are both solid at the time of pack-out. Such preconditioning may involve, for example, preconditioning one or both of the phase change materials at −20° C. for a first period of time and then at +3° C. for a second period of time.

Although, in the present embodiment, the two different types of phase-change material are disposed in different planes, this need not be the case as the two different phase-change materials may be arranged in the same plane. This may be done, for example, by filling some of inner temperature-control members 101-1 through 101-3 with one of the phase change materials and filling the other inner temperature-control members 101-1 through 101-3 with the other phase change material and/or by filling some of outer temperature-control members 103-1 through 103-3 with one of the phase change materials and filling the other outer temperature-control members 103-1 through 103-3 with the other phase change material. Alternatively, this may be done, for example, by filling some of the pouches 102 within a given inner temperature-control member 101 (or some of the pouches 104 within a given outer temperature-control member 103) with one phase change material and by filling the other pouches 102 within the same inner temperature-control member 101 (or the other pouches 104 of the same outer temperature-control member 101) with the other phase change material. In fact, inner temperature-control members 101-1 through 101-3 and/or outer temperature-control members 103-1 through 103-3 may be replaced with any conceivable arrangement of two different phase-change materials, whether they be disposed in one plane, multiple planes, or otherwise. For example, the two phase change materials may be arranged as the "C" and "H" phase change materials, respectively, in FIG. 8 of U.S. Pat. No. 5,899,088, inventor Purdum, issued May 4, 1999, which is incorporated herein by reference, or in any of the other embodiments disclosed in U.S. Pat. No. 5,899,088. The relative amounts of the two phase change materials may be substantially equal or may be unequal (e.g., 75% by mass of one phase change material and 25% by mass of the other phase change material). For example, in the case of the above-described +5° C./+7° C. system, the system may contain 75%, by mass, of the +5° C. phase-change material and 25%, by mass, of the +7° C. phase-change material.

Figure 13:
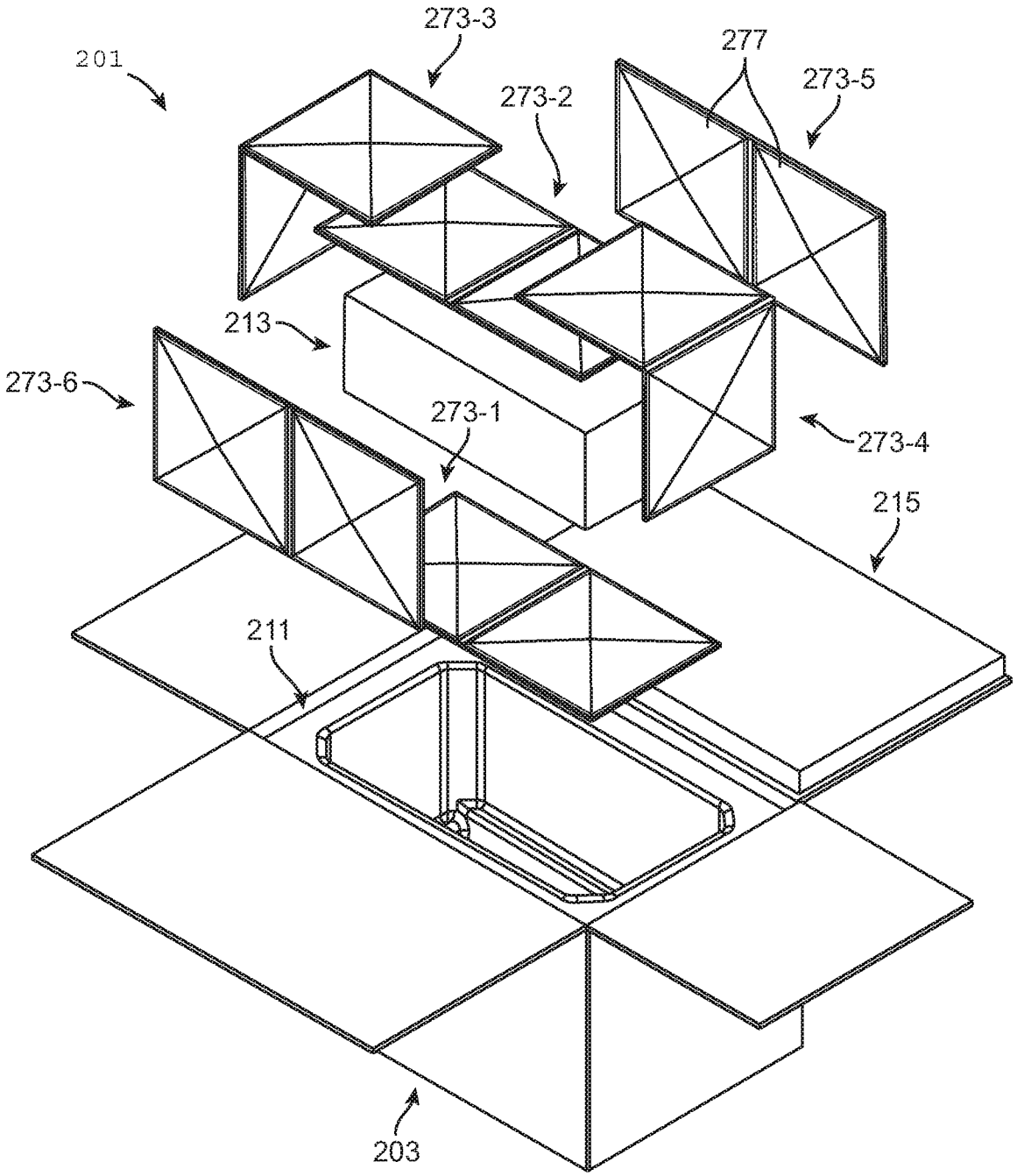
FIG. 13 is a partly exploded perspective view of a second embodiment of a shipping system suitable for use in storing and/or transporting temperature-sensitive materials, the shipping system being constructed according to the teachings of the present invention.

As another example, FIG. 13 shows a shipping system 201 that is similar in some respects to shipping system 11, one difference between shipping systems 11 and 201 being that shipping system 201 includes an outer box 203, a liner 211, a product box 213, and a lid assembly 215, all of which may be of an elongated rectangular shape. Another difference between shipping systems 11 and 201 may be that shipping system 201 may comprise temperature-control members 273-1 through 273-6, each of which may comprise two pouches 277. Each pouch 277 of temperature-control members 273-1, 273-2, 273-5 and 273-6 may comprise the first phase-change material. By contrast, whereas the side-facing pouches 277 of temperature-control members 273-3 and 273-4 also may comprise the first phase-change material, the top-facing pouches 277 of temperature-control members 273-3 and 273-4 may comprise the second phase-change material.

It is believed that a system comprising a combination of phase-change materials of the type described above provides surprisingly superior thermal protection as compared to analogous systems that include only a single phase-change material. For example, in the case of a dual-PCM (phase-change material) system that comprises both a +5° C. phase change material and a +7° C. phase-change material preconditioned to the same state, each of the phase-change materials has one or more desirable attributes to contribute to the system. For example, on one hand, high latent heat is a desirable attribute, and the +5° C. phase change material described above tends to have a greater latent heat than the corresponding +7° C. phase change material. On the other hand, as noted above, systems designed to maintain payloads at temperatures +2° C. to +8° C. are often stored, at some stage during transit, in an active temperature-control system, such as an electric refrigerator, that is typically operated at around +5° C. Consequently, while being held in a +5° C. refrigerator or the like, the +7° C. phase change material is more likely than the +5° C. phase change material to re-solidify. So, in effect, this unique combination combines the latent heat benefits of the +5° C. phase change material with the "recharging" benefits of the +7° C. phase-change material; thus, if the shipping system is placed into a refrigerator during transit, the +5° C. phase-change material, in theory, neither thaws nor freezes while the +7° C. phase-change material re-solidifies. Then, if the shipping system is placed into a +5° C. customs hold in a country, after a certain amount of time, at least a portion of the +7° C. phase-change material will have fully re-solidified to allow for an additional period of thermal protection during transit.

It is to be understood that, although the above-described +5° C./+7° C. dual-PCM system is described in the context of systems 11 and 201, the use of a +5° C./+7° C. dual-PCM system is not limited to systems 11 and 201. Rather, such a dual-PCM system could be used in any sort of shipping system (parcel, pallet or otherwise), pallet cover or the like, examples of which include, but are not limited to, systems of the type disclosed in U.S. Pat. Nos. 10,583,978, 10,661,969, 10,604,326, and U.S. Patent Application Publication No. US 2021/0070539 A1, inventors Chasteen et al., published Mar. 11, 2021, all of which are incorporated herein by reference. Moreover, the two PCMs could be coplanar, layered, or otherwise arranged. For example, and without limitation, in the pallet shipping system of U.S. Patent Application Publication No. US 2021/0070539 A1, the two PCMs could be arranged so that one of the PCMs is confined to above a midline of the payload space and the other PCM is confined to below the midline of the payload space.

Although not shown, to facilitate assembly of system 11, one or more of inner temperature-control members 101-1 through 101-3 and outer temperature-control members 103-1 through 103-3 may be removably or permanently housed in a sleeve or container (e.g., a corrugate sleeve or container, or a polymeric sleeve or wrap). For example, inner temperature-control member 101-1 and outer temperature-control member 103-1 may be housed within a first sleeve or container, inner temperature-control member 101-2 and outer temperature-control member 103-2 may be housed within a second sleeve or container, and inner temperature-control member 101-3 and outer temperature-control member 103-3 may be housed within a third sleeve or container. In particular, in instances where the inner and outer temperature-control members are pre-conditioned at the same temperature and are preconditioned prior to being loaded in the insulated container, such pre-conditioning may take place with the inner and outer temperature-control members housed within their corresponding sleeve or container. Instead of using a sleeve or container, one or more inner temperature-control members and one or more outer temperature-control members may be coupled to one another by other techniques, such as, but not limited to, shrink-wrapping, hook and loop fasteners, adhesive tape, glue, and the like.

Temperature-control members 101-1 through 101-3, temperature-control members 103-1 through 103-3, and product box 99 may be appropriately dimensioned and arranged within liner 81 as follows: First, temperature-control member 101-1 may be arranged within liner 81 so that two of its four pouches are positioned within lower portion 83-1 of cavity 83 and so that two of its four pouches are positioned in upper portion 83-2 of cavity 83 on top of intermediate portion 91 and along side wall 87-3 of liner 81. The two pouches sitting within lower portion 83-1 of cavity 83 may be dimensioned to fit snugly therewithin. Temperature-control member 103-1 may then be arranged in liner 81 in an analogous fashion on top of temperature-control member 101-1. Product box 99 may then be positioned on top of the two pouches of temperature-control member 103-1 positioned within lower portion 83-1 of cavity, with the bottom of product box 99 substantially aligned with the bottom of upper portion 83-2 of cavity 83. Temperature-control member 101-2 may then be positioned between liner 81 and product box 99 so that two of its four pouches are positioned on top of intermediate portion 91 of side wall 87-1 and so that two of its four pouches are positioned on top of intermediate portion 91 of side wall 87-4. Temperature-control member 103-2 may then be arranged in an analogous fashion outside of temperature-control member 101-2. Temperature-control member 101-3 may then be positioned within liner 81 so that two of its four pouches are positioned on top of intermediate portion of side wall 87-2 and so that two of its four pouches are positioned on top of product box 99. Temperature-control member 103-3 may then be arranged in an analogous fashion over temperature-control member 101-3. Preferably, liner 81, product box 99, temperature-control members 101-1 through 101-3, and temperature-control members 103-1 through 103-3 are dimensioned so that temperature-control members 101-1 through 101-3 and temperature-control members 103-1 through 103-3 fit snugly around product box 99 within liner 81. As can be appreciated, the method described above is exemplary; accordingly, the order in which temperature-control members 101-1 through 101-3 and temperature-control members 103-1 through 103-3 are placed around product box 99 and the positioning of temperature-control members 101-1 through 101-3 and temperature-control members 103-1 through 103-3 relative to product box 99 and liner 81 may be varied without departing from the present invention.

System 11 may further comprise a vacuum insulated panel 111. Vacuum insulated panel 111 may be similar or identical in construction to vacuum insulated panels 53-1 through 53-5. A plurality of fasteners (not shown) that may be complementary to fasteners 25-1 through 25-4 may be secured, for example, by adhesive or similar means to vacuum insulated panel 111 and may be arranged on vacuum insulated panel 111 so as to permit detachable mating with fasteners 25-1 through 25-4. In this manner, vacuum insulated panel 111 may be detachably secured to top closure flap 19-1 of outer box 13.

Figure 12:
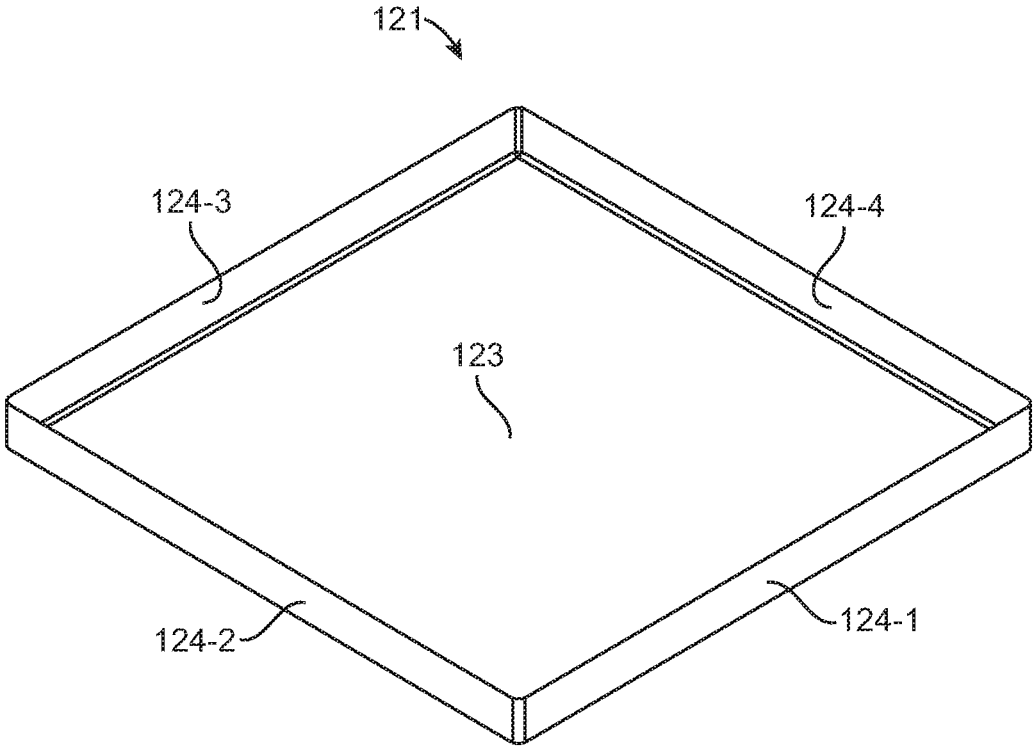
FIG. 12 is a perspective view of the cover shown in FIG. 3.

System 11 may further comprise a cover 121. Cover 121, which is also shown separately in FIG. 12, may be made of the same material as liner 81 or may be made of a material similar thereto. Cover 121 may be shaped to include a bottom 123, a plurality of sides 124-1 through 124-4, and an open top. Cover 121 may be appropriately dimensioned to cover the bottom and sides of vacuum insulated panel 111. A plurality of fasteners 125-1 through 125-4 may be secured, for example, by an adhesive or similar means to the interior faces of sides 124-1 through 124-4 of cover 121, and complementary fasteners (not shown) may be secured, for example, by an adhesive or similar means to the peripheral edges of vacuum insulated panel 111 at locations thereon that permit detachable mating with fasteners 125-1 through 125-4. In this manner, vacuum insulated panel 111 may be detachably secured to cover 121. In the present embodiment, fasteners 125-1 through 125-4 may be hook (or loop) fasteners, with complementary loop (or hook) fasteners being secured to vacuum insulated panel 111; however, it is to be understood that other types of fasteners, such as adhesive fasteners applied to one or both of vacuum insulated panel 111 and cover 121, may also be used. Also, although four fasteners 125-1 through 125-4 are shown in the present embodiment, it is to be understood that a greater number or lesser number of fasteners 125-1 through 125-4 may be used without departing from the present invention.

Vacuum insulated panel 111 is preferably positioned on top closure flap 19-1 and cover 121 is preferably positioned on vacuum insulated panel 111 so that liner 81 may be closed simply by the closure of top closure flap 19-1. In this regard, cover 121 and vacuum insulated panel 111 may be collectively regarded as a lid assembly 122 for insulation unit 51.

System 11 may further comprise a temperature indicator (not shown). The temperature indicator, which may be a conventional temperature indicator, may be positionable on top of product box 99 below the top two pouches of temperature-control member 101-3 and may be used to give a real-time indication of whether or not product box 99 is within a desired temperature range. For example, the temperature indicator may indicate a positive condition (e.g., by displaying a particular color or symbol) if the temperature is within the desired temperature range and may indicate a negative condition (e.g., by displaying a particular color or symbol) if the temperature is outside of the desired temperature range. Alternatively, the temperature indicator may provide a real-time temperature reading. As can readily be appreciated, the temperature indicator may be replaced with or may additionally have the capability to measure or to detect shock/movement, global position, moisture/humidity or another environmental parameter.

System 11 minus temperature-control members 101-1 through 101-3 and temperature-control members 103-1 through 103-3 may be referred to herein as a shipper.

One may assemble system 11 as follows: First, outer box 13 may be formed from blank 27, and the bottom closure flaps of outer box 13 may be closed and, preferably, sealed. Next, data logger 41 may be inserted into opening 45 of board 43, and the combination of data logger 41 and board 43 may be placed in the bottom of outer box 13. Next, liner 81 (with pads 97-1 through 97-4 secured thereto) may be placed in insulation unit 51, and the combination of insulation unit 51 and liner 81 may be placed in outer box 13 on top of board 43. Next, cover 121 may be secured to vacuum insulated panel 111, and the combination of cover 121 and vacuum insulated panel 111 may be secured to closure flap 19-1. (Tab 21 may be secured to closure flap 19-1 prior to securement of cover 121 and vacuum insulated panel 111 to closure flap 19-1.)

Next, temperature-control members 101-1 through 101-3, temperature-control members 103-1 through 103-3, and product box 99 may be placed in liner 81. Next, top closure flaps 19-1 through 19-4 may be closed, the closure of top closure flap 19-1 causing lid assembly 122 to be swung down on top of liner 81 and insulation unit 51.

The following example is given for illustrative purposes only and is not meant to be a limitation on the invention described herein or on the claims appended hereto.

Example

The efficacy of a two-PCM approach is demonstrated using Finite Element Analysis (FEA) simulation under simplified conditions. The model uses plane walls with the same cross-sectional area to represent heat flow through layers of insulation, phase-change material, and a heat sink. Although the model is three-dimensional, all heat flow takes place in one direction, which is often referred to as one-dimensional heat transfer. Thermal protection often aims to keep products in a refrigerated state, commonly defined as +2° C. to +8° C. Therefore, the various systems discussed below are compared on how long the heat sink remains within the refrigerated temperature range, referred to as the duration.

Figure 14:
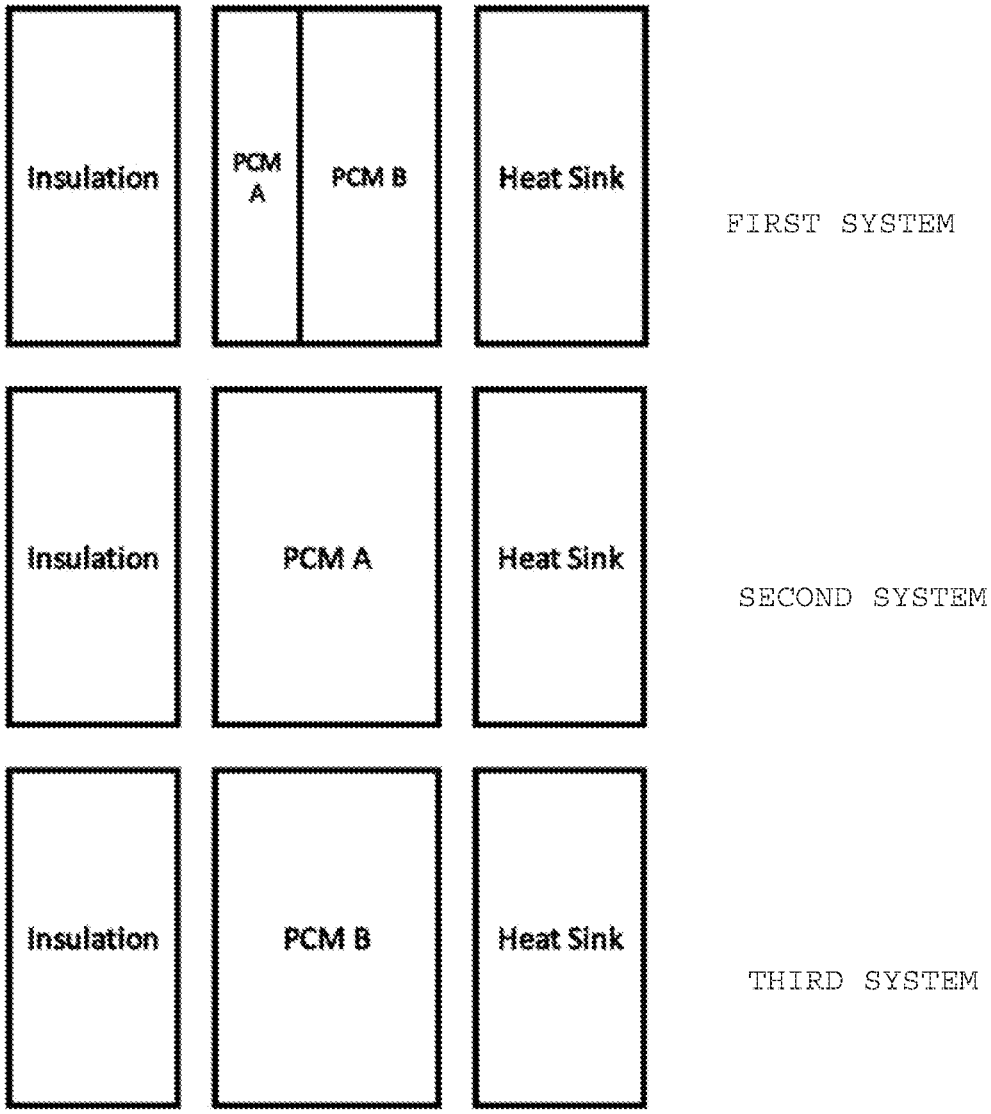
FIG. 14 is a schematic rendering of the three systems of the Example.

Three systems, which are schematically shown in FIG. 14, are investigated. The first system, which is a dual-PCM system, consists of a layer of insulation followed by a layer of a first phase-change material (designated "PCM A"), a layer of a second phase-change material (designated as "PCM B"), and a layer of a heat sink. The second system, which is a single-PCM system, consists of a layer of insulation, followed by a layer of PCM A and a layer of the heat sink. The third system, which is also a single-PCM system, consists of a layer of insulation, followed by a layer of PCM B and a layer of the heat sink.

For purposes of the simulation, each layer of insulation and each heat sink is considered to have a thickness of 25.4 mm. The combined masses of PCM A and PCM B in the first system are considered to be equal to the mass of PCM A in the second system and to be equal to the mass of PCM B in the third system (i.e., 0.2152 kg). The distribution of PCM in the first system is considered to be 25% PCM A and 75% PCM B. The layers are considered to be connected by a perfect contact where the temperature at one surface is equal to the temperature of the surface in contact. The cross-section of each layer is considered to measure 100 mm×100 mm. The initial temperature of the heat sink and both PCMs is considered to be 3° C. The initial temperature of the insulation is considered to be 20° C. The relevant thermal properties of the insulation and the heat sink are found below in Table 1.

TABLE 1

| Property | Insulation | Heat Sink |
|---|---|---|
| Thermal Conductivity (W/m · K) | 0.034 | 0.13 |
| Density (kg/m$^3$) | 32 | 10 |
| Specific Heat (J/kg · K) | 1130 | 1000 |

The relevant thermal properties of PCM A and PCM B are found below in Table 2.

TABLE 2

| Property | PCM A | PCM B |
|---|---|---|
| Phase Change Range | 6.5° C.-7.75° C. | 5° C.-6.25° C. |
| Solid Specific Heat (J/kg · K) | 1700 | 1700 |
| Latent Heat (kJ/kg) | 155 | 185 |
| Liquid Specific Heat (J/kg · K) | 2000 | 2000 |
| Density (kg/m^3) | 800 | 800 |
| Thermal Conductivity Solid (W/m · K) | 0.6 | 0.6 |
| Thermal Conductivity Liquid (W/m · K) | 0.2 | 0.2 |

The insulation values are representative of a material similar to expanded polystyrene (EPS), a common insulation material. The PCM properties are considered to be typical of commercially available phase change materials, such as CrodaTherm waxes (Croda Europe Ltd., Balingen, Germany). The software models the phase change such that latent heat is evenly distributed over the phase change range, which is a reasonable approximation of actual PCM behavior.

The first, second, and third systems of the simulation are considered to be subjected to convection to the environment on the outer face of the insulation. The convection coefficient for free convection typically ranges from 2 W/m$^2$·K to 25 W/m$^2$·K (See Incropera, Frank P., and David P. DeWitt, *Fundamentals of Heat and Mass Transfer,* 5th Ed, J. Wiley (2002), which is incorporated herein by reference.) For this simulation, a convection coefficient of 5 W/m$^2$·K is selected. The ambient temperature of the environment as a function of time is found below in Table 3. Any intermediate values are determined by linear interpolation.

TABLE 3

| Time (Hour) | Temperature (° C.) |
|---|---|
| 0 | 30 |
| 42 | 30 |
| 42.01 | 6.3 |
| 200 | 6.3 |
| 200.01 | 30 |
| 224 | 30 |

The temperature and time conditions are selected to represent a scenario where a shipping system in transit during summer months is exposed first to elevated ambient temperatures, then is abruptly transitioned to refrigeration (such as being held in a customs facility in a cold room), then resumes its journey under elevated ambient temperatures. A temperature of 30° C. is chosen to represent ambient summer temperatures. A temperature of 6.3° C. is chosen to represent the refrigerated storage. In this scenario, the shipping system is in transit for 42 hours prior to refrigerated storage, and the storage period is 200 hours. The temperature as a function of time is shown above in Table 3. Intermediate temperature values are calculated by linear interpolation.

Figure 15:
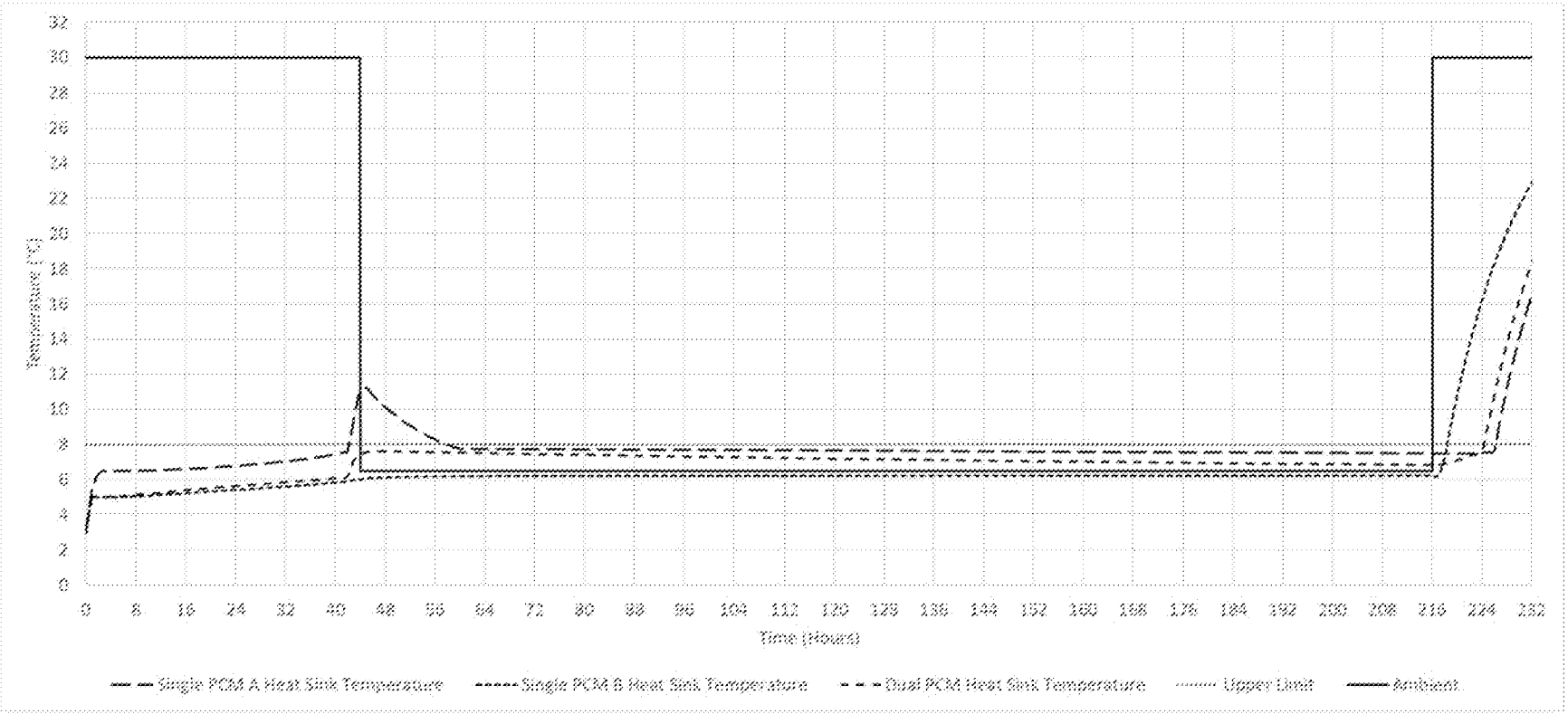
FIG. 15 is a graph depicting the results of the Example.

The results from exposing the three systems to the ambient temperatures in Table 3 are depicted graphically in FIG. 15. The results represent the average temperature of the heat sink, a proxy for the shipping system payload, which may be, for example, a vaccine requiring refrigerated storage. The duration of protection afforded by each system is found below in Table 4.

TABLE 4

| Example | Active Duration (hours) | Post-Refrigeration Duration (hours) |
|---|---|---|
| First System (Dual PCM) | 52 | 8 |
| Second System (Single PCM A) | 42 | N/A |
| Third System (Single PCM B) | 46 | 2 |

The duration can be looked at in several ways. The active duration may be regarded as the time the payload spent protecting the heat sink from the 30° C. ambient temperature. The first system has an active duration that is 13% better than the next best option, namely, the third system. This is despite the fact that the second PCM has a lower latent heat value and is attributable to the fact that the second PCM regains latent heat during the refrigeration period. The duration of the first system is also 300% longer than the third system after the refrigeration period (i.e., 8 hours compared to 2 hours). The second system has the lowest active duration and has no post-refrigeration duration because it allows the payload to exceed specification temperature before refrigeration.

In summary, finite element analysis (FEA) demonstrates that two phase change materials (PCMs) in an insulated container can provide superior thermal protection to the payload of the container than either of the two PCMs individually under certain conditions. In a preferred embodiment of the invention, both PCMs have different latent heats and different phase change temperature ranges from each other, although both PCMs may undergo phase change in the same direction (i.e. both changing from liquid to solid or both changing from solid to liquid). The utility of the invention is magnified when there is an interim period where the ambient temperature is such that one PCM reverses the direction of its phase change while the other continues to change phase in the original direction or stops changing phase altogether. These conditions may occur in real-life if a temperature-controlled shipment that uses PCMs is exposed to temperatures that are warmer than the product during normal shipping but is interrupted by a delay that causes the shipment to be stored in a refrigerator or other temperature-controlled environment.

The embodiments of the present invention described above are intended to be merely exemplary and those skilled in the art shall be able to make numerous variations and modifications to it without departing from the spirit of the present invention. All such variations and modifications are intended to be within the scope of the present invention.

What is claimed is:

1. A passive temperature-control shipping system for use in keeping a payload within a desired temperature range of about +2° C. to +8° C. for a period of time while exposed to an ambient environment warmer than the desired temperature range, the passive temperature-control shipping system comprising:

(a) one or more thermal insulation members arranged to at least partially bound a space;

(b) a first phase-change material associated with the one or more thermal insulation members, the first phase-change material having a phase-change temperature that is within the desired temperature range and that is at or below a refrigerating hibernation temperature, the refrigerating hibernation temperature being within the desired temperature range; and (c) a second phase-change material associated with the one or more thermal insulation members, the second phase-change material being physically discrete from the first phase-change material and having a phase-change temperature that is different than that of the first phase-change material and that is above the refrigerating hibernation temperature;

(d) wherein both the first phase-change material and the second phase-change material are preconditioned to be in a solid phase at pack-out and wherein both the first phase-change material and the second phase-change material are in a liquid phase when at equilibrium with the ambient environment, whereby, by hibernating the passive temperature-control shipping system at the refrigerating hibernation temperature after the first and second phase-change materials have at least partially melted, the second phase-change material at least partially refreezes whereas the first phase-change material continues to melt or stops changing phase.

2. The passive temperature-control shipping system as claimed in claim 1 wherein the phase-change temperature of the first phase-change material is about +5° C. and wherein the refrigerating hibernation temperature is approximately +5° C. to +6° C.

3. The passive temperature-control shipping system as claimed in claim 2 wherein the phase-change temperature of the second phase-change material is within the desired temperature range.

4. The passive temperature-control shipping system as claimed in claim 3 wherein the phase-change temperature of the second phase-change material is about +7° C.

5. The passive temperature-control shipping system as claimed in claim 4 wherein the first phase change material and the second phase change material are preconditioned to the solid phase in a first step at a temperature of minus 20° C. and then in a second step at a temperature of +3° C.

6. The passive temperature-control shipping system as claimed in claim 4 wherein the first phase-change material and the second phase-change material are arranged in different planes, with the first phase-change material more proximal to the payload and with the second phase-change material more distal to the payload.

7. The passive temperature-control shipping system as claimed in claim 6 wherein the first phase-change material is present in a greater mass and the second phase-change material is present in a lesser mass.

8. The passive temperature-control shipping system as claimed in claim 7 wherein the first phase-change material and the second phase-change material are present in a 3:1 ratio by mass.

9. The passive temperature-control shipping system as claimed in claim 1 wherein the first phase-change material and the second phase-change material are arranged coplanar.

10. The passive temperature-control shipping system as claimed in claim 1 wherein the first phase-change material and the second phase-change material are arranged in different planes.

11. The passive temperature-control shipping system as claimed in claim 1 wherein the first phase-change material and the second phase-change material are present in equal quantities.

12. The passive temperature-control shipping system as claimed in claim 1 wherein the first phase-change material and the second phase-change material are present in unequal quantities.

13. The passive temperature-control shipping system as claimed in claim 1 wherein the passive temperature-control shipping system is pallet-sized.

14. The passive temperature-control shipping system as claimed in claim 1 wherein the passive temperature-control shipping system is parcel-sized.

15. The passive temperature-control shipping system as claimed in claim 1 wherein the passive temperature-control shipping system is a pallet cover.

16. A passive temperature-control shipping system for use in keeping a payload within a desired temperature range of about +15° C. to +25° C. for a period of time while exposed to an ambient environment warmer than the desired temperature range, the passive temperature-control shipping system comprising:

one or more thermal insulation members arranged to at least partially bound a space;

a first phase-change material associated with the one or more thermal insulation members, the first phase-change material having a phase-change temperature that is within the desired temperature range; and a second phase-change material associated with the one or more thermal insulation members, the second phase-change material being physically discrete from the first phase-change material and having a phase-change temperature that is different than that of the first phase-change material;

wherein, at pack-out, both the first phase-change material and the second phase-change material are in a first phase that is different from a second phase in which the first and second phase-change materials exist when at equilibrium with the ambient environment, wherein the phase-change temperature of one of the first phase-change material and the second phase-change material is at or below a hibernation temperature, the hibernation temperature being within the desired temperature range, and the phase-change temperature of the other of the first phase-change material and the second phase-change material is above the hibernation temperature, whereby, by hibernating the passive temperature-control shipping system at the hibernation temperature after the first and second phase-change materials have at least partially changed from the first phase to the second phase, the second phase-change material at least partially changes back to the first phase whereas the first phase-change material continues to change to the second phase or stops changing phase.

17. A method of transporting and/or storing a payload comprising a temperature-sensitive material, the method comprising the steps of:

(a) providing the passive temperature-control shipping system of claim 1;

(b) loading a payload into the passive temperature-control shipping system while both the first phase-change material and the second phase-change material are in the solid phase; and (c) then, subjecting the passive temperature-control shipping system to the ambient environment warmer than the desired temperature range until the first phase-change material and the second phase-change material at least partially melt.

18. The method as claimed in claim 17 further comprising the step of transporting the passive temperature-control shipping system.

19. The method as claimed in claim 17 further comprising, after step (c), hibernating the passive temperature-control shipping system at the refrigerating hibernating temperature until the second phase-change material at least partially refreezes whereas the first phase-change material continues to melt or stops changing phase.

20. The method as claimed in claim 19 further comprising, after the hibernating step, again subjecting the passive temperature-control shipping system to the ambient environment warmer than the desired temperature range.

21. The method as claimed in claim 17 wherein the phase-change temperature of the first phase-change material is about +5° C.

22. The method as claimed in claim 21 wherein the phase-change temperature of the second phase-change material is within the desired temperature range.

23. The method as claimed in claim 22 wherein the phase-change temperature of the second phase-change material is about +7° C.

24. The method as claimed in claim 23 wherein the first phase change material and the second phase change material are preconditioned to the solid phase in a first step at a temperature of minus 20° C. and then in a second step at a temperature of +3° C.

25. The method as claimed in claim 23 wherein the first phase-change material and the second phase-change material are arranged in different planes, with the first phase-change material more proximal to the payload and with the second phase-change material more distal to the payload.

26. The method as claimed in claim 25 wherein the first phase-change material is present in a greater mass and the second phase-change material is present in a lesser mass.

27. The method as claimed in claim 26 wherein the first phase-change material and the second phase-change material are present in a 3:1 ratio by mass.

28. A method of transporting and/or storing a payload comprising a temperature-sensitive material, the method comprising the steps of:

(a) providing one or more thermal insulating members;

(b) providing a first phase-change material, the first phase-change material having a phase-change temperature that is within a range of about +2° C. to +8° C. and that is at or below a refrigerating hibernation temperature, the refrigerating hibernation temperature being within the range of about +2° C. to +8° C.;

(c) providing a second phase-change material, the second phase-change material having a phase-change temperature that is greater than that of the first phase-change material and that is above the refrigerating hibernation temperature;

(d) conditioning both the first phase-change material and the second phase-change material at a temperature at which both are in a solid phase;

(e) associating the first phase-change material and the second phase-change material with the one or more thermal insulation members to form a system having a payload space;

(f) loading the payload into the payload space while the first phase change material and the second phase change material are solid;

(g) then, subjecting the system to an ambient environment that is warmer than +8° C. until the first phase-change material and the second phase-change material at least partially melt; and (h) then, hibernating the system at the refrigerating hibernation temperature until the second phase-change material at least partially refreezes whereas the first phase-change material continues to melt or stops changing phase.

29. The method as claimed in claim 28 further comprising, after the hibernating step, once again subjecting the system to the ambient environment that is warmer than +8° C.

30. The method as claimed in claim 29 wherein the phase-change temperature of the first phase-change material is about +5° C., wherein the phase-change temperature of the second phase-change material is about +7° C., and wherein the refrigerating hibernation temperature is approximately +5° C. to +6° C.

31. The method as claimed in claim 28 wherein the conditioning step comprising subjecting the first phase change material and the second phase change material to a first conditioning temperature of minus 20° C. and then to a second conditioning temperature of +3° C.

* * * * *